US006860677B2

(12) United States Patent
Johnston

(10) Patent No.: US 6,860,677 B2
(45) Date of Patent: Mar. 1, 2005

(54) FLOATING RIVER DEBRIS SKIMMER

(76) Inventor: Barry Johnston, 2423 Pickwick Rd., Baltimore, MD (US) 21207

( * ) Notice: Subject to any disclaimer, the term of this patent is extended or adjusted under 35 U.S.C. 154(b) by 0 days.

(21) Appl. No.: 10/464,846

(22) Filed: Jun. 19, 2003

(65) Prior Publication Data

US 2004/0115003 A1 Jun. 17, 2004

Related U.S. Application Data

(60) Provisional application No. 60/389,930, filed on Jun. 20, 2002, provisional application No. 60/426,036, filed on Nov. 14, 2002, and provisional application No. 60/452,954, filed on Mar. 10, 2003.

(51) Int. Cl.[7] ..... E02B 15/04

(52) U.S. Cl. ..... 405/63; 405/64; 405/71; 210/169

(58) Field of Search ..... 405/63, 64, 70, 405/71, 72; 210/169, 747, 199, 220, 922, 923; 441/65

(56) References Cited

U.S. PATENT DOCUMENTS

| | | | | | |
|---|---|---|---|---|---|
| 3,651,647 | A | * | 3/1972 | Flaviani | 405/63 |
| 3,653,213 | A | * | 4/1972 | Childers | 405/63 |
| 3,939,663 | A | * | 2/1976 | Tezuka et al. | 405/63 |
| 4,053,412 | A | * | 10/1977 | Stix | 210/169 |
| 4,388,188 | A | * | 6/1983 | Morris | 405/71 |
| 4,425,053 | A | * | 1/1984 | Muto et al. | 405/63 |
| 4,472,842 | A | * | 9/1984 | Jarrett | 405/63 |
| 5,264,122 | A | * | 11/1993 | Lakotish | 210/169 |
| 5,350,508 | A | * | 9/1994 | Van der Watt | 210/169 |
| 6,062,170 | A | * | 5/2000 | Finch et al. | 114/222 |
| 6,117,336 | A | * | 9/2000 | Sachse | 210/747 |
| 6,488,445 | B1 | * | 12/2002 | Claeson et al. | 405/63 |

FOREIGN PATENT DOCUMENTS

| | | | | |
|---|---|---|---|---|
| DE | 3438336 | * | 4/1986 | |
| JP | 61057704 | * | 3/1986 | 405/63 |

* cited by examiner

*Primary Examiner*—Jong-Suk Lee
(74) *Attorney, Agent, or Firm*—Lowe Hauptman & Berner, LLP

(57) ABSTRACT

A skimmer for removing debris off the surface of a river includes a float line installed across the river at an angle with respect to the river current, and a collecting net installed at the downstream end of the float line. The ends of the line are slidable upwards, along inclined supports, to unsnag the line when a heavy object hooks onto the line. A second mechanism, assisting in raising the line, is a series of rods which swivel in a pole-vaulted fashion from their leverage at the bottom of the river to lift the line out of the water and allow the heavy object to pass underneath. If the object hits the line with an excessive force, the line will reliably break at a desired weak point. The rods may have elbow joints that would provide better leverage in shallow water.

26 Claims, 35 Drawing Sheets

FLOATING RIVER DEBRIS SKIMMER

The instant application claims priority from Provisional Application Nos. 60/389,930 filed Jun. 20, 2002; 60/426,036, filed Nov. 14, 2002; and 60/452,954, filed Mar. 10, 2003, which are incorporated by reference herein in their entireties.

TECHNICAL FIELD

The present invention generally relates to floating river debris skimmers. More particularly, the present invention relates to a floating river debris skimmer having a float line obliquely installed across the river and a mechanism for assisting in lifting the float line, at least partially, out of the water.

BACKGROUND OF THE INVENTION

Floating pollution on our rivers and streams increases dramatically with heavy rains and rising water levels. Nets, stretching the length of the stream, have been used to collect the rubble but heavy debris tears through and destroys the setup. It has been known to include a line of steel baskets jointed as a collector net to catch the trash. This basket system supposedly will endure the abuse of the heavy debris.

Therefore, there is a need for an apparatus for and method of collecting the floating debris in a netted area at one of the banks where it can easily be collected. The heavy rubble, such as floating logs, will pass without damaging the skimming device.

SUMMARY OF THE INVENTION

It is, therefore, an object of the present invention to provide a simple, inexpensice and easy-to-construct floating river debris skimmer which does not have, or at least lessens, the above mentioned problems. The rubble/trash skimmer's installer should be able to use commercially available devices such as swimming pool float dividers with minimal distraction to the natural landscape in constructing the skimmer.

It is another object of the present invention to provide a floating river debris skimmer which can rise and fall smoothly with the water level of the river and which does not obstruct waterway traffic along the river.

It is a further object of the present invention to provide a floating river debris skimmer which allows removal of light weight debris with ease, while passing heavier floating objects without destroying or damaging the skimmer.

It is yet another object of the present invention to provide a floating river debris skimmer line which, in practice, reliably breaks upon application of an excessive load caused e.g. by a heavy object travelling with the river current.

These and other objects of the present invention are achieved by a method of selectively skimming debris off a surface of a river or stream. The method comprises the steps of installing a float skimming line across the river at an angle with respect to a flowing direction of the river, and collecting debris at a downstream end of the float skimming line.

The above and other objects of the present invention are also achieved by a skimmer for selective removal of objects floating on a surface of a stream. The skimmer comprises a float skimming line installed across the stream at an angle with respect to a flowing direction of the stream.

In accordance with an aspect of the present invention, the skimmer further comprises a lifting mechanism attached to the float skimming line for moving the float skimming line at least partially out of the water when a floating object travelling downstream hits the float skimming line with a predetermined force, thereby allowing the floating object to pass under the float skimming line.

In accordance with a further aspect of the present invention, the lifting mechanism comprises at least one elongated member extending in the flowing direction of the stream and downwardly from the surface of the stream to a bottom thereof. The elongated member has an upper end being attached to the float skimming line at a location between the upstream and downstream ends of the float skimming line, and a lower end removably anchored to the bottom of the stream so that the upper end, and hence the float skimming line, can be pole-vaulted off the surface of the stream when an object of predetermined size and weight travelling downstream hits the float skimming line.

In preferred embodiments, the upper end of the elongated member may be rigidly or pivotably attached to the float skimming line. The lower end of the elongated member may be simply anchored to the stream bottom with a pointed portion, or pivotably attached to an anchor body.

In accordance with another aspect of the present invention, the lifting mechanism comprises two guiding members each defining a guiding path extending from a bottom of the stream upwardly and in the flowing direction of the stream. Each of the upstream and downstream ends of the float skimming line is attached to be slidable along one of the guiding member so that the float skimming line is free to rise and fall with a level of the stream and to be elevated, at least partially, from the surface of the stream when an object of predetermined size and weight travelling downstream hits the float skimming line.

In preferred embodiments, the ends of the float skimming line are connected with the respective guiding members by connection rings. The guiding members may be rigid rods or cables. The supports for the guiding members may be connected together by e.g. a cable spanning over the stream, or may be individually constructed near opposite bank edges of the stream. The guiding members may extend parallel with the flowing direction of the stream or may extend towards each other.

In accordance with yet another aspect of the present invention, the skimmer further comprises a collecting net installed at the downstream side of the float skimming line. The net is preferably constructed taking into account the lowest and highest water levels of the stream.

The float skimming line may be comprised of a single elongated buoyant member, or a plurality of individual floats connected in series. The float skimming line preferably has a weak point which will reliably break upon application of an excessive force thereto. The float skimming line may have circular or multisided configurations.

In accordance with another aspect of the present invention, the trash skimmer float line must be kept taut during operation. Two approaches of maintaining the tension utilize the drag of the downstream current. One approach is to hang a log from the float line below the downstream end post. However, if this approach does not provide sufficient tension along the float line, then according to the second approach, both ends of the float line can be attached to a hanging log, which is dangled sideways against the pressure of the full current of the stream. The log is preferably weighted so to keep submerged at the bottom (at the stream bed) out of the way of floating debris. The effective cross sectional area of the dragging log is preferably somewhat greater than the effective cross sectional area of the float line.

In accordance with another aspect of the present invention, the collection net is attached to a triangular frame which swivels up and down at a pivot point at the downstream end post located at a high water level mark of the nearside. The swiveling triangular frame for the neck of the collector net is attached to the downstream end post and to the float line skimmer which moves up and down with the rise or fall of the water level.

In accordance with another aspect of the present invention, at the upstream end of the float line, an elongated cylindrical float keeps the float line weighted down to accommodate the varying water levels. Its length will be the horizontal measurement between the high and low water marks. Thus, when the water level rises and falls, the skimmer float line stays with the water level with the aid of the elongated float attached to the far, upstream end post.

In accordance with another aspect of the present invention, a preferred embodiment of the pole vaults includes an elbow arm structure that would provide better leverage in shallower water. In particular, the arm of each pole vault may be provided with an elbow which allows the flow line to be partially lifted out of the water thus improving the leverage angle of the vaulting action so that the vaulting mechanism can continue to effectively lift the float line out of the water.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout, and wherein.

BEST MODE FOR CARRYING OUT THE INVENTION

Figure 1:
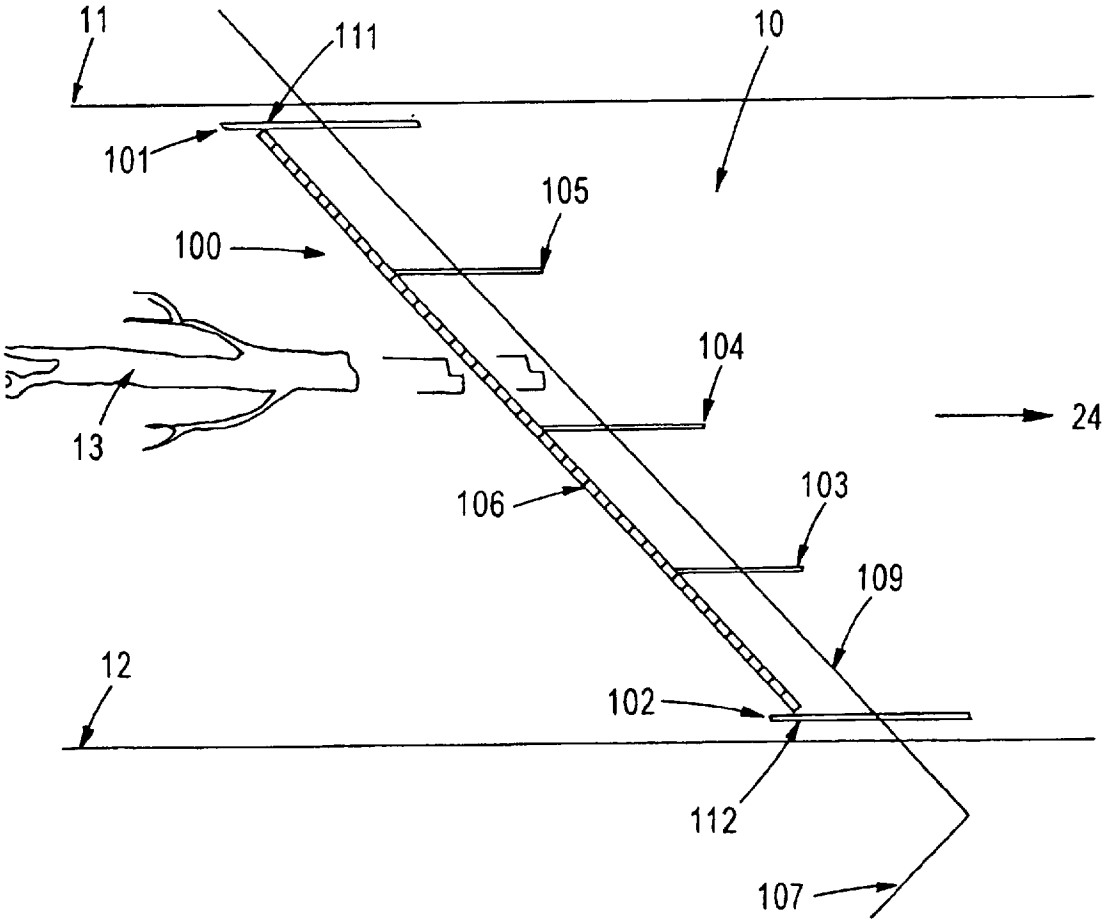
FIG. 1 is a schematic top plan view showing a floating river debris skimmer of the present invention.

A floating river debris skimmer and a method of installing and using the floating river debris skimmer in accordance with the present invention are described. In the following detailed description, for purposes of explanation, numerous specific details are set forth in order to provide a thorough understanding of the present invention. It will be apparent, however, that the present invention may be practiced without these specific details. In other instances, well-known structures and devices are schematically shown in order to simplify the drawing.

Referring now to FIG. 1, floating river debris skimmer 100 is shown. Skimmer 100 includes float line 106 installed across river 10 at an angle with respect to flowing direction 24 of the river. Skimmer 100 further includes two supports 101, 102 installed near the river bank edges 11, 12, respectively. As can be seen in FIG. 1, supports 101, 102 are attached to upstream and downstream ends 111, 112 of float line 106, respectively. The ends of float line 106 can slide along guiding members of supports 101, 102 as will be described below. There are numerous pole members 103–105 installed at regular intervals along float line 106. Pole members 103–105 have upper ends attached to float line 106 and submerged lower ends anchored to the bottom of the river as will be described below. Debris collector 107 is installed at the downstream side of float line 106. As can be seen in FIG. 1, float line 106 includes a plurality of buoyant members 108 and is slanted at about 45° with respect to flowing direction 24 (the river current) to allow the debris to wedge toward debris collector 107. In other words, the debris is herded along the float line and captured at or near the downstream end 112 by e.g. a net as will be described in more detail below.

Figure 2:
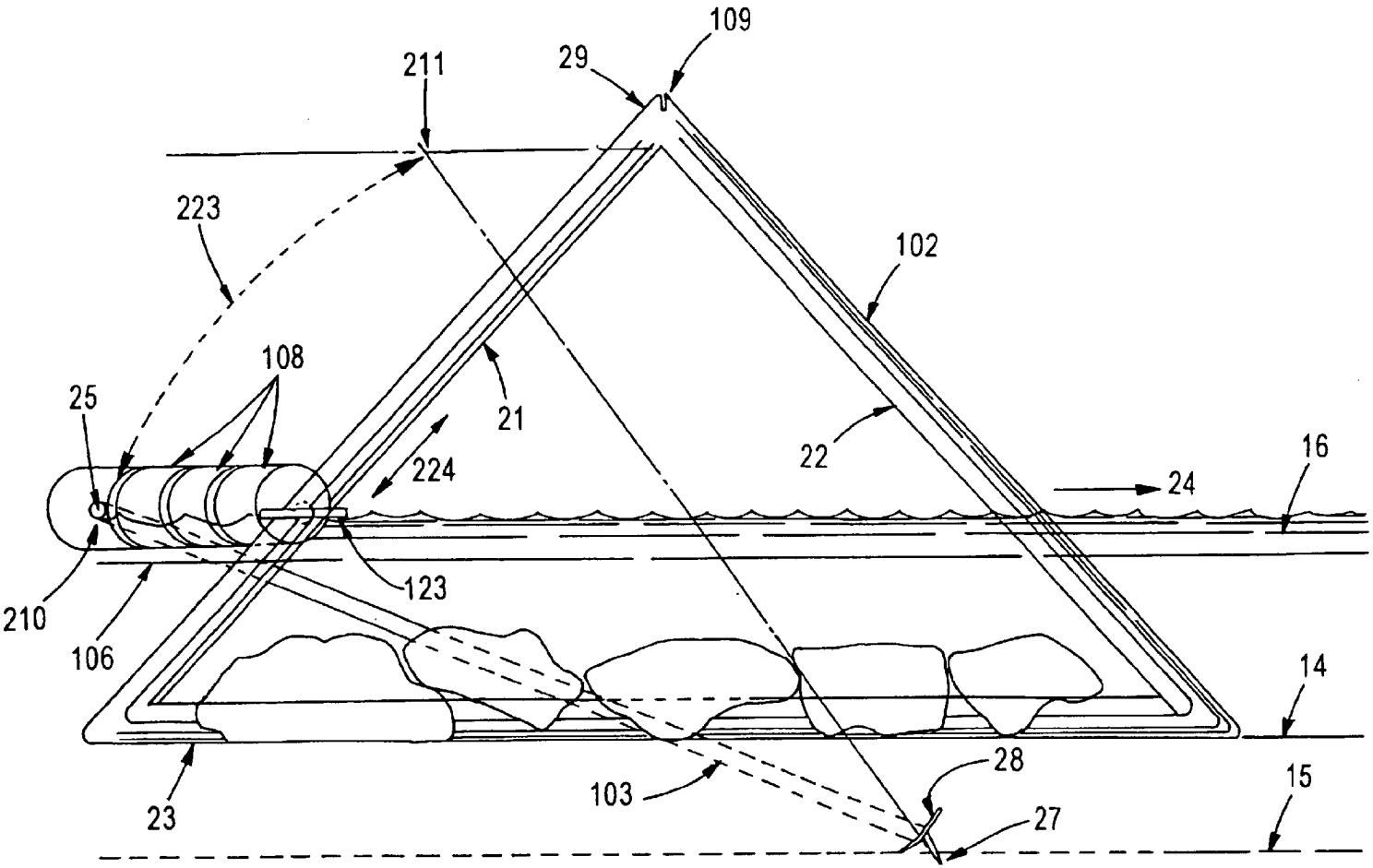
FIG. 2 is a perspective view showing partially the downstream side of a preferred embodiment of the floating river debris skimmer of the present invention.
Figure 3:
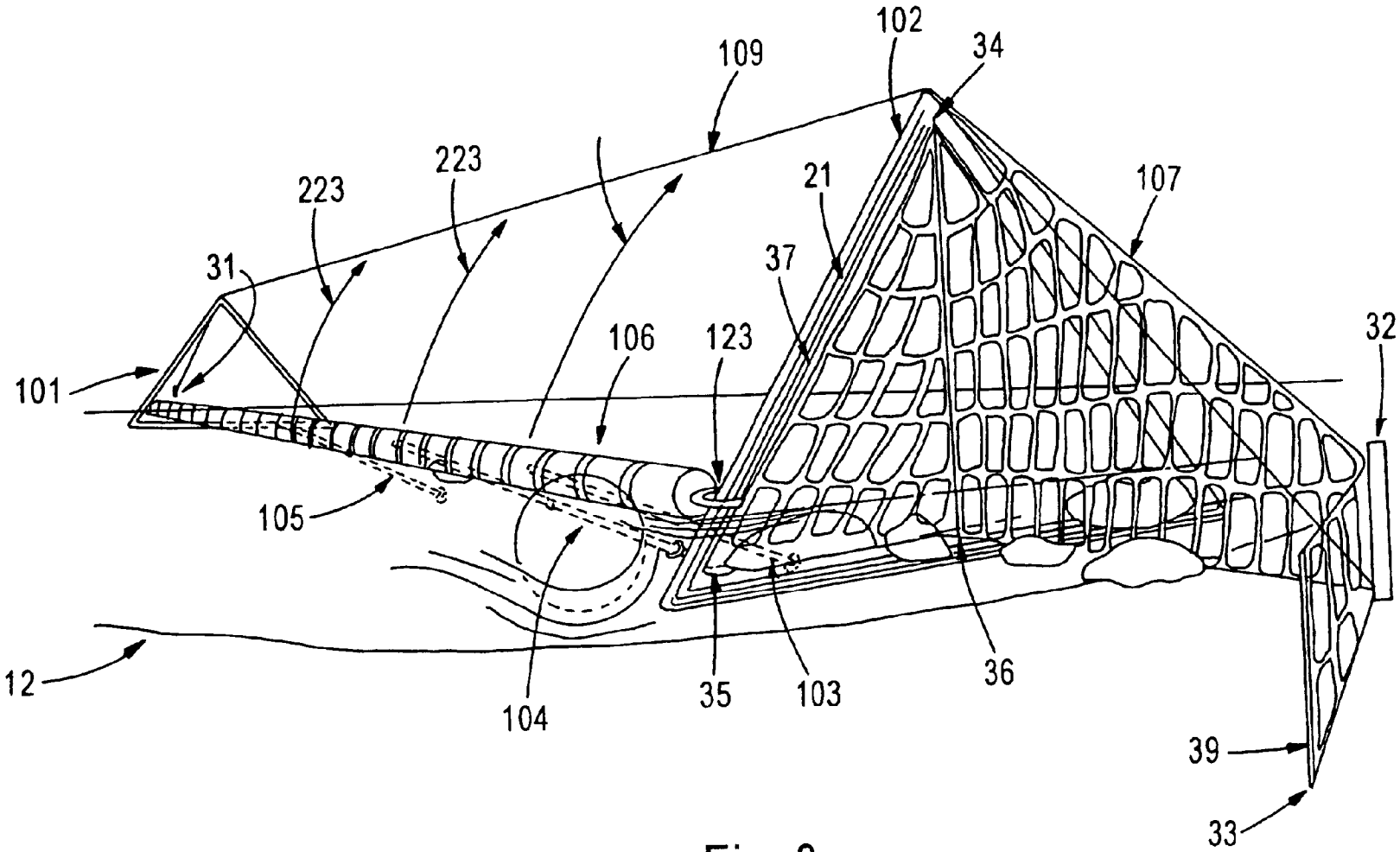
FIG. 3 is a perspective view showing the preferred embodiment illustrated in FIG. 2.

Referring to FIGS. 2–3, skimmer 100 of FIG. 1 is shown in more detail. It should be noted that supports 101, 102 are preferably configured identically and therefore it is necessary to describe only one of them. As can be seen in FIG. 2, downstream side support 102 is a triangular shaped pipe bipod having first side 21 serving as the guiding member for the downstream end 112 of float line 106. Bipod 102 also has opposite side 22 and base 23 positioned on and/or anchored by river rock 14. As best seen in FIG. 3, triangular bipods 101, 102 are anchored at their top 29 by a steel cable 109 spanning the river and anchored to two steel stakes 31, 32, respectively, driving into the opposite bank surfaces. The ends of float line 106 have sliding rings 123 that loop around the respective guiding members i.e. the upstream sides of the two bipod triangles 101, 102. Of course, it is desirable to set cable 109 high enough to allow boats travelling along the river to pass underneath. As can be seen in FIG. 2, guiding members 21 of supports 101, 102 extend at about 45° with respect to the water surface.

Debris collector 107 which is preferably a net attached to the face of downstream bipod 102, to steel stake 32, and extending 90° out from the stake, is shaped to contain the collected debris. More particularly, a first section of net 107 is attached to bipod 102 at upper point 34 near the apex of bipod 102, and lower point 35 near the corner where guiding member 21 and base 23 meet. Edge 37 of net 107 is left free from bonding to guiding member 21 in between upper and lower points 34, 35, thereby allowing sliding ring 123 to slide between points 34, 35 without obstruction. It should be noted that point 35 is preferably higher than or at least coelevational with the lowest water level expected in river 10. Net 107 is also attached to bipod 102 at middle point 36 of base 23. Net 107 further includes second and third sections extending between bipod 102 and stake 32, and between stake 32 and stake 33, respectively. It should be noted that the lowest point 39 of stake 33 is preferably higher than or at least coelevational with the highest water level expected in river 10. Advantageously, debris collector or net 107 is made with three sections as described above. However, other configurations such as two section net 413 in FIG. 4 or even a single section net (not shown) may be used as well.

FIG. 2 also shows pole member 103 having upper end 25 connected at 210 to a buoyant member 108 of float line 106 and a lower end 26 which is a weighted end, and hence sinks and seats on the bottom of the river. Lower end 26 has a flange 28 and a pointed anchoring projection 27 best seen in FIG. 12A. Body 1210 of pole member 103 is generally straight and has a longitudinal direction. Projection 27 is preferably inclined at about 45° with respect to the longitudinal direction of body 1210. Flange 28 prevents projection 27 from being excessively sunk into river mud 15.

The skimmer of the present invention operates in the following fashion. Small debris travelling downstream hits and is guided by float line 106 towards debris collector 107 where it will be eventually removed from the river either by hand or by machine. Most of the floating debris is collected in the net when the water level is high. The net/debris collector is designed like a lacrosse goal at the water's edge and bank. Mostly i.e. 99% of the time, the personnel collecting the trash will do it when the water level is low. In a preferred embodiment, debris collector 107 is a disposable net made of a recyclable and, advantageously, environment-friendly, material. The collecting personnel can detach or unhook the disposable net from the respective support, guiding member and stakes, and dispose of the net with the debris captured therein. The collecting personnel will then install a new or recycled net which is also disposable. This makes the trash collecting process simple with minimal amounts of time and effort.

As discussed in the foregoing section, an advantage of the present invention is the capability of collecting small debris while allowing larger and/or heavier floating objects such as log 13 in FIG. 1 to pass under float line 106. This can be achieved by one or both lift assisting mechanisms of the present invention which are guiding members 21 and pole members 103–105. In particular, float line 106 moves up and down at its downstream and upstream ends. When a heavy object, i.e. log 13, hooks onto float line 106, the line is pulled up out of the water up to e.g. five feet, thereby unsnagging the object from the float line. Sliding rings 123, which provide slidable connection between the ends of float line 106 and guiding members 21, slide up and down (arrow 224, FIG. 2) the approximately 45° side of bipods 101, 102 to unsnag float line 106. When object 13 is freed, float line 106 slides back down along the guiding members 21.

The second mechanism, assisting in raising float line 106, is a series of preferably light-weight pole members or pole vaults 103 which, as can be seen in FIG. 1, are preferably attached at equal spacing along float line 106. Pole members 103 are strong poles weighted on their downstream (lower) end causing them to sink and seat on bottom 15 (FIG. 2) of the river/stream. When the heavy stuff i.e. log 13 pulls on float line 106, one or more pole members 103–105 swivel in a pole vault fashion from their leverage (lower end) at the bottom of the river/stream, describing a circular arc (223, FIGS. 1–2), lifting float line 106 out of the water and allowing the heavy stuff (log 13) to pass. If one or more pole members is/are hit by the heavy stuff, the hit pole member(s) come(s) unhinged from the bottom of the river, allowing the heavy stuff to pass underneath. Those pole members which are not hit remain anchored at the bottom and pole vault float line 106 over the passing log. Advantageously, all pole members reseat into their original position once the heavy stuff has passed.

Figure 4:
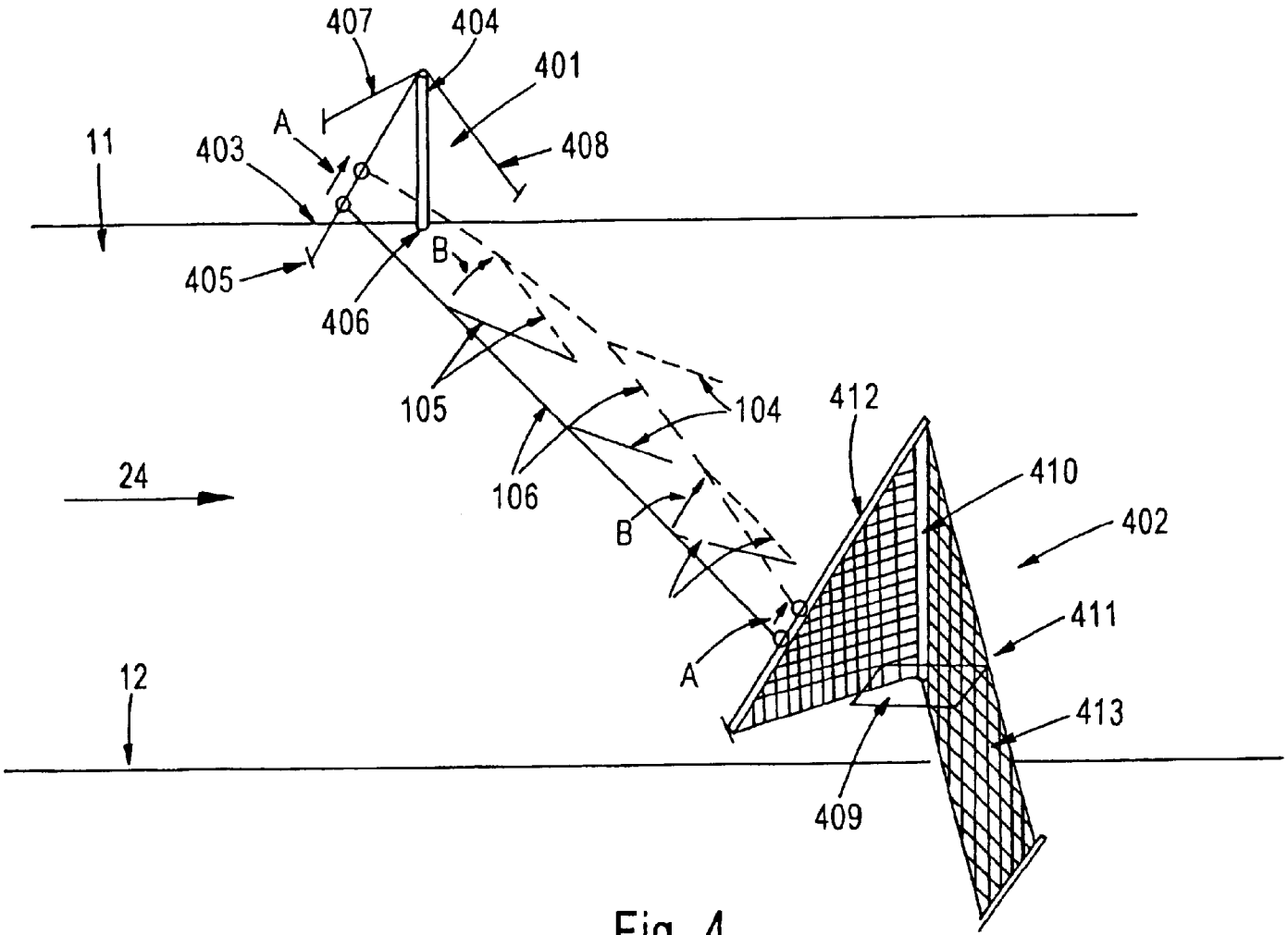
FIG. 4 is a schematic perspective view showing another embodiment of the present invention.

The immediately foregoing description may be better understood referring to FIG. 4. In FIG. 4, the solid line denotes the state of float line 106 (on the water surface) before and after lifting, and the phantom line denotes the state of float line 106 (at least partially out of the water) during the passing of log 13 (not shown). It is assumed that log 13 hits float line 106 at or in the vicinity of the connection point of pole member 104 and float line 106. If float line 106 and pole member 104 are hit hard enough, the lower end of pole member 104 will be dislodged from the river bottom as illustrated by the phantom line. The other pole members, i.e. 103 and 105, however, will remain anchored and pivot about their respective lower ends to lift float line 106 in a pole vault fashion over the log. Simultaneously, the upstream and downstream ends of float line 106 are moved up respective guiding members 21 in the direction of arrows A. These displacements of float line 106 may or may not be sufficient to completely raise the entire float line out of the water. However, at least in the middle region of float line 106 where pole member 104 is hit, the float line will be sufficiently lifted off the water surface to allow log 13 to pass underneath. After log 13 has passed, the ends of float line 106 as well as the upper ends of pole members 103 and 105 return to their original position in directions opposite to arrows A and B. Pole member 104 also returns to its original state with the lower end seating back on the bottom of the river. It should be noted that if the heavy debris does not hit pole member 14 too hard, pole member 14 will not be dislodged and will pivot about its lower end to pole vault float line 106 in the same manner as pole members 103 and 105. Similarly, more than one pole members may be unhinged when heavy debris pulls on float line 106.

Figure 15D:
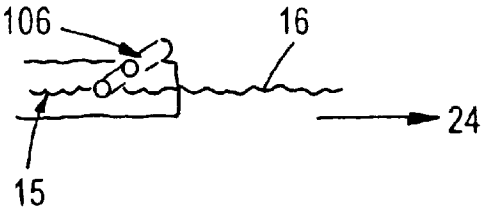
FIGS. 15A–15D are schematic side or top plan views showing the operation of a floating river debris skimmer equipped with or without a lift assisting mechanism.
Figure 15C:
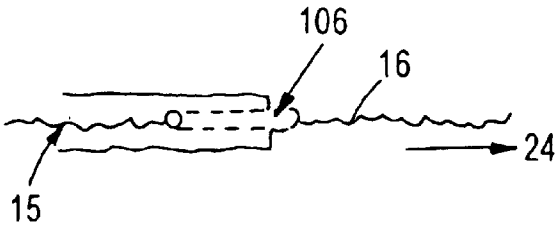
Figure 15B:
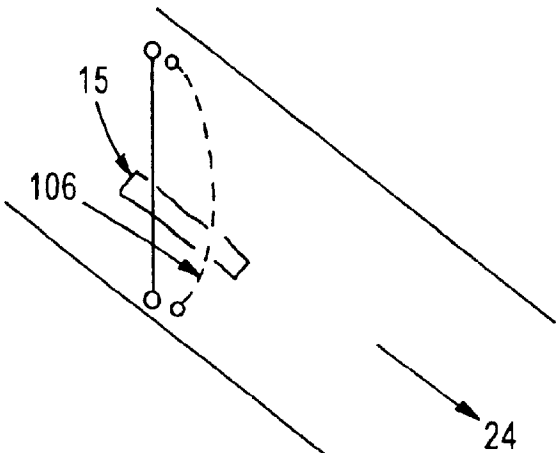
Figure 15A:
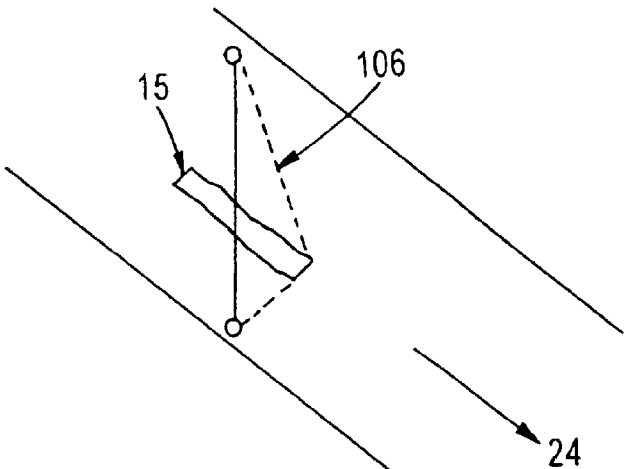

The advantage of skimmer 100 equipped with one or both of the above described lift assisting mechanisms over a skimmer formed without such mechanisms will be apparent from FIGS. 15A–15D in which the solid line denotes the state of float line 106 before and after lifting, and the phantom line denotes the state of float line 106 during the pass of log 13. FIGS. 15A, 15C and 15B, 15D show skimmers 100 formed without and with the lift assisting mechanisms, respectively. FIGS. 15A and 15B are top plan views while FIGS. 15C and 15D are side elevation views.

As can be seen on FIGS. 15A, 15C, when heavy debris 13, which in most cases is partially submerged, hits float line 106, there is no assurance that the log can pass through float line 106 because the line cannot be reliably raised above water level 16. In the worst scenario, log 13 entangles in float line 106, seriously deforms the line, and may eventually break it, as can be seen in FIG. 15A. However, if skimmer 100 is equipped with the lift assisting mechanisms, float line 106 will be reliably raised above water level 16 both in the middle region where the log hits and at the downstream and upstream ends of the float line. Log 13 is thus allowed to easily pass under the lifted float line without causing damage thereto.

In addition, it might still be desirable to provide skimmer 100 with not only the lift assisting mechanisms but also at least one weak point which will reliably break upon application of an excessive force to float line 106. Thus, if heavy debris 13 entangles in the float line, or hits the float line too hard, or if the float line is not lifted fast enough, damages to the skimmer will be kept minimal. Possible arrangements for such a weak point will be described herein below.

It should be note that the present invention is not limited to the above description. For example, although it has been described that float line 106 is preferably slanted at about 45° with respect to flowing direction 24 (the river current) to allow the debris to wedge toward debris collector 107, this angle may vary depending on many factors, including but not limited to, the current rate of river 10, the strength of float line 106, the space available for construction of the skimmer, etc.

Moreover, while it has been shown in FIG. 1 that the pole members are distributed evenly along float line 106, other arrangements e.g. with more pole members in the middle of the river and fewer pole members near the banks, may be suitable depending, again, on many factors. For example, if it has been found that logs or other heavy objects are more likely to hit float line 106 in the middle than at the ends, the above alternative arrangement allows for easier lifting of the middle part of float line 106 which improves the effectiveness of the skimmer.

Guiding members 21 of supports 101, 102 have been described to extend at about 45° with respect to the water surface. However, this angle may vary depending on many factors as discussed above. Other configurations for supports 101, 102 are also available. For example, base 23 of supports 101, 102 may be omitted. Each of supports 101, 102 can be erected as an individual structure, i.e. a tripod, and therefore cable 109 is no longer necessary.

Guiding member 21 can also be cables or ropes stretched between an upper end of support 101 or 102 and an anchor point, i.e. a stake driven into the river bed. This kind of structure is shown in FIG. 4 at 401, 402. Support 401 is pole 406 anchored by three cables 403, 407 and 408 one of which, i.e. cable 403, serves as the guiding member for the upstream end of float line 106. Cable 403 is stretched between upper end 404 of pole 406 and stake 405 driven into the river bed. Sliding ring 123 of the upstream end of float line 106 slides up and down along cable 403. Support 402 is configured slightly differently with column 410 erected from a solid and heavy foundation such as concrete 411. Guiding member 412 in support 402 is freed from the function of anchoring column 410 and is intended only to guide the respective sliding ring. Guiding member 412 which is a thin rod or cable therefore may be made with a smaller cross section or of a cheaper/lower quality material than cable 403 of support 401.

It has been described that pole members 103–105 are preferably identical. However, it is within the scope of the present invention to customize pole members 103–105 depending on their positions in the river. For example, pole members 103–105 may have different lengths. Short pole members are easier to pivot about their lower end than long pole members. However, the clearance provided by shorter pole members is smaller than that provided by longer pole members. It will be apparent to skilled artisans to vary the length of pole members 103–105 to obtain optimum operation of skimmer 10 under different circumstances.

Figure 5:
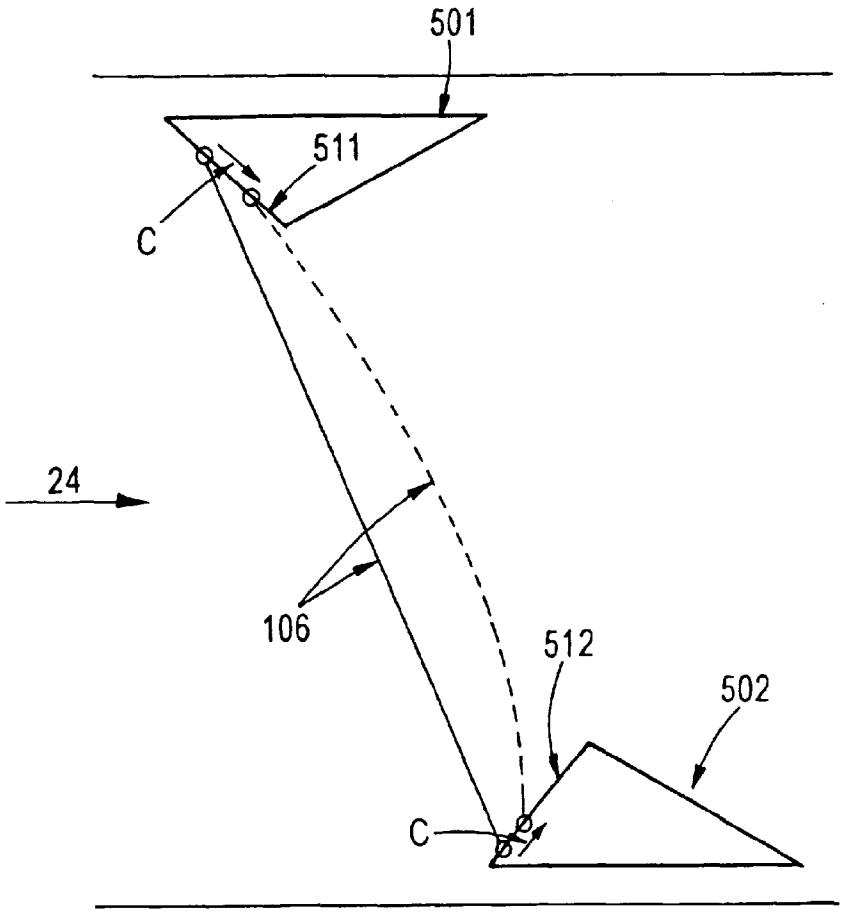
FIG. 5 is a schematic top plan view showing yet another embodiment of the present invention.

FIG. 5 is a top plan view illustrating an alternative embodiment for supports 101, 102 of the skimmer of the present invention. In skimmer 10 of FIG. 1, supports 101, 102 are arranged in parallel planes which are also parallel with river current 24. Supports 501, 502 in FIG. 5 are different from supports 101, 102 of FIG. 1 in that supports 501, 502 are arranged in non-parallel planes. In other words, one or both guiding members 511, 512 of supports 501, 502 are directed inwardly towards the middle of the river. Thus, when the downstream and upstream ends of float line 106 are moved up in the directions of arrows C, the distance between the ends is shortened, whereby the middle portion of the float line 106 can be lifted higher than in skimmer 100 of FIG. 1.

Figure 6:
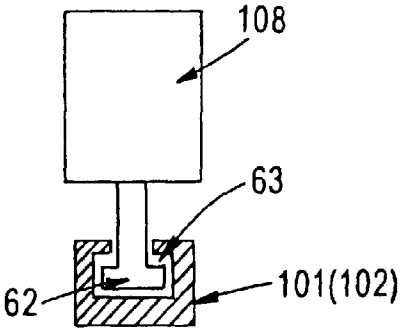
FIG. 6 is a cross section view showing a preferred connection of a float line and a guiding member of the skimmer of the present invention.

FIG. 6 is a partially cross sectional view showing an alternative embodiment for the connection between the ends of float line 106 and guiding members 21 of supports 101, 102. In the embodiment of FIG. 6, end buoyant member 108 of float line 106 has projection 62 which is preferably T-shaped. Guiding member 21 of the respective support 101 or 102 is provided with matching elongated recess 63 which conforms in size and shape to projection 62, thereby allowing projection 62 to slidably ride along guiding member 21. A reversed arrangement (not shown) with a recess provided in the end buoyant member of float line 106 and the respective guiding member formed as a matching elongated raised rail can be contemplated by skilled artisans.

Figure 7:
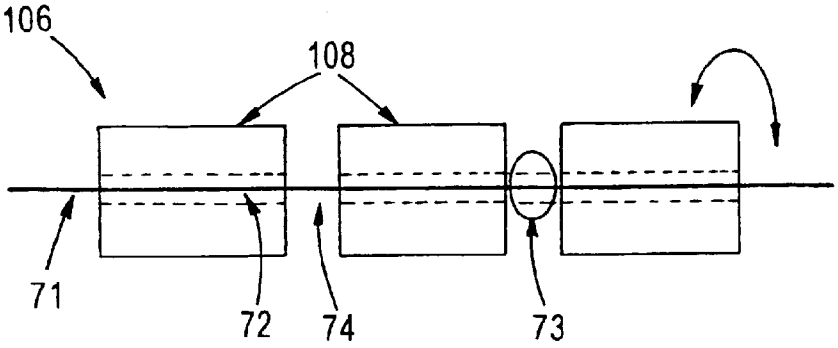
FIGS. 7–10 are front or perspective views showing various configurations of the float line of the present invention.

FIGS. 7–10 shows various embodiments for float line 106. As described with respect to FIGS. 1–3, float line 106 preferably includes a plurality of discrete buoyant members 108. Each buoyant member 108 may be made hollow or solid from a suitable material to have adequate buoyancy. An example for float line 106 is float divider lines used in swimming pools. In FIG. 7, float line 106 includes a number of buoyant members 108 each having a through hole 72, and string 71 extending through holes 72. Neighboring buoyant members 108 may be positioned adjacent to each other with or without a small gap 74 there between. Alternatively, there may be a buffer element 73 spacing neighboring buoyant members 108. Buffer element 73 may be buoyant or may be not. Preferably, buffer element 73 is smaller in size than buoyant members 108. The inclusion of buffer elements 73 and/or presence of gaps 74 enhance flexibility of float line 106. The stretchability of float line 106 is dictated by string 71. It should be noted that small debris may pass between adjacent buoyant members 108 through gaps 74. In this aspect, the embodiment with buffer elements 73 may be more desirable because buffer elements 73 prevent the small debris from passing through float line 106. It should also be noted that buoyant members 108 are advantageously rotatable about string 71 which in turn will assist heavy debris to pass under float line 106 when the heavy debris is in contact with one or more rotatable buoyant members 108.

Figure 8:
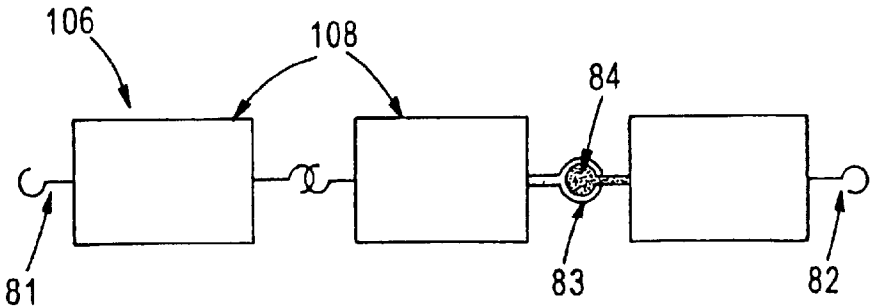

In FIG. 8, each buoyant member 108 has two attaching members, e.g. hooks 81, 82, to attach to each other. This type of attachment limits movement of the connected buoyant members with respect to each other. An alternative embodiment is depicted at 83, 84 where male member 84 and matching female member 83 are provided at opposite ends of each buoyant member 108. Preferably, male member 84 is loosely or movably retained within female member 83. As a result, the connected buoyant members 108 are allowed greater mobility than in the hook connection.

Figure 9:
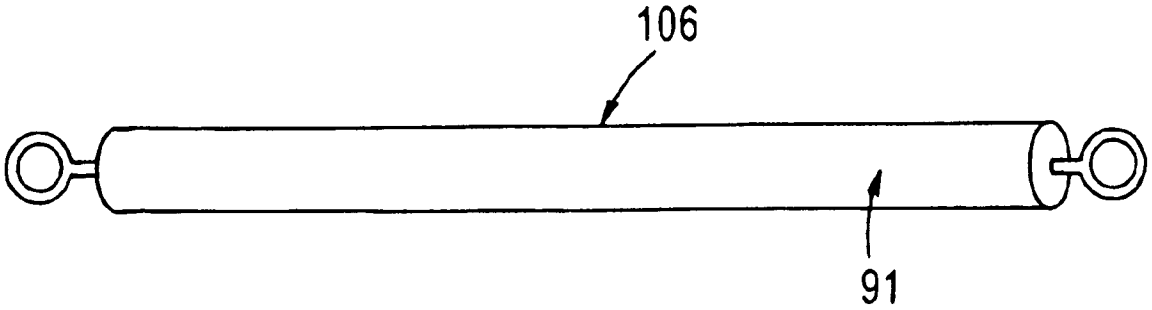

In FIG. 9, float line 106 is formed as a single buoyant element 91 which continuously extends from the upstream end to the downstream end of float line 106. Element 91 should apparently have adequate buoyancy. Preferably, element 91 should also be flexible and/or stretchable to facilitate easy riding of float line 106 above the water surface. An advantage of the single buoyant element float line of FIG. 9 over the multiple buoyant element float line resides in that element 91 provides a continuous contact surface with the water which prevents small debris from passing through float line 106 e.g. between adjacent individual buoyant members 108 as described with respect to FIG. 7. The single buoyant element float line may, however, have disadvantages that the skimmer of FIG. 7 does not have e.g. the single element float line is more difficult to manufacture and/or transport and/or install.

Figure 10:
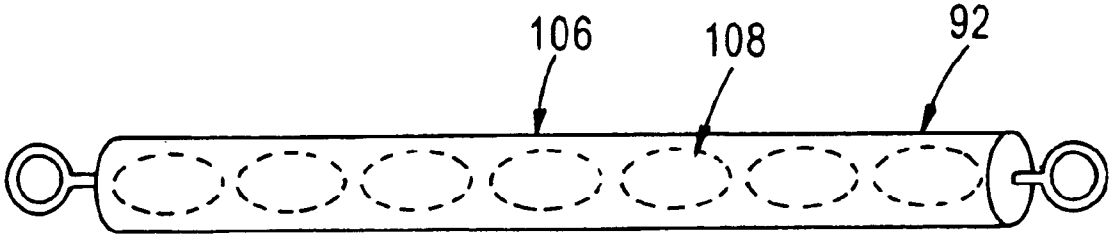

An intermediate embodiment for float line 106 is shown in FIG. 10 which has a series of individual floats as illustrated in FIGS. 7–8 enclosed in a continuously extending cover 92. The float line of FIG. 10 combines advantages of both the single buoyant element and multiple buoyant element arrangements as will be apparent to skilled artisans.

Figure 11A:
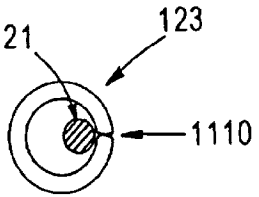
FIGS. 11A–11C are cross section views showing various configurations of a weak point incorporated in the float line of the present invention.
Figure 11B:
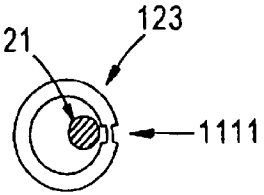
Figure 11C:
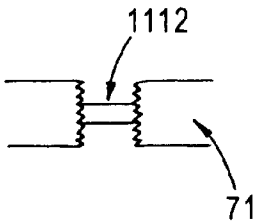

FIGS. 11A–11C illustrate different embodiments for a weak point of the float line 106. In FIGS. 11A–11B, the weak point is incorporated in sliding ring 123 at one or both ends of the float line. In FIG. 11A, sliding ring 123 is made of a flexible material e.g. metal and includes slit 1110 which will open to allow guiding member 21 to pass through when an excessive force is applied to float line 106. In FIG. 11B, sliding ring 123 is formed with a reduced cross section portion 1111 which will break to disengage guiding member 21 from sliding ring 123 when an excessive force is applied to float line 106. In the arrangement of FIG. 11A sliding ring 123 is undestructively deformed while in the arrangement of FIG. 11B sliding ring 123 unrecoverably breaks. In FIG. 11C, the weak point is incorporated in string 71 of float line 106 shown in FIG. 7. Weak point 1112 in this instance includes only a central or core portion of string 71 which will break when an excessive force is applied to float line 106. In the embodiment of FIG. 8, one of the attaching portions may be made weaker than the other.

Figure 12A:
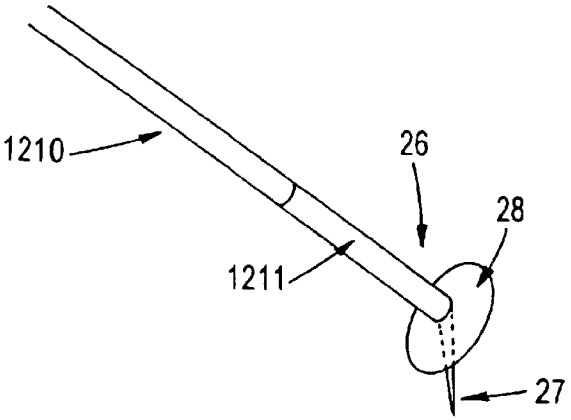
FIGS. 12A–12B show various configurations of a lower end of a pole vault of the present invention.
Figure 12B:
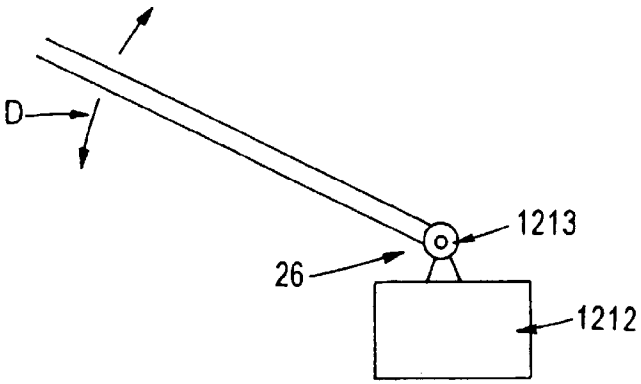

FIGS. 12A–12B depict preferred embodiments for the lower end of pole member e.g. 103. In FIG. 12A, body 1210 has a weighted portion 1211 which may be made from a material other and heavier than that of the remaining part of body 1210 including upper end 25. Alternatively, weighted portion 1211 may be made of the same material as the remaining part of body 1210 but has a larger cross section. Another possible configuration is to make body 1210 hollow except for weighted portion 1211.

FIG. 12B shows another embodiment of lower end 26 of pole member 103. In FIG. 12B, lower end 26 is connected at 1213 to an anchor body 1212. The connection at 1213 may be rigid. However, it is advantageous to rotatably connect lower end 26 to anchor body 1212 so that pole member 103 can pivot about connection 1213 as indicated by arrow D in FIG. 12B. This configuration makes it easier to trigger and conduct the pole-vault action of pole member 103.

Figure 13A:
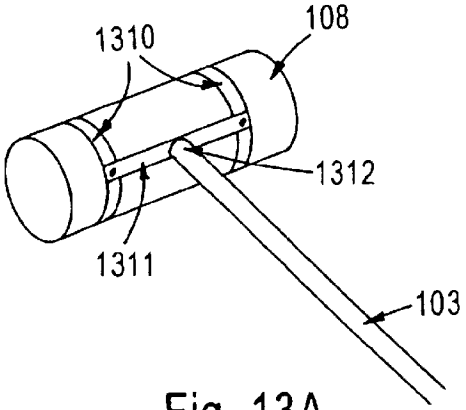
FIGS. 13A–13F show various preferred connections between an upper end of the pole vault and the float line of the present invention.

FIGS. 13A–13D show various possible connections between float line 106 and pole members 103–105. In FIG. 13A, connection 210 between pole member 103 and one buoyant member 108 of float line 106 includes one or more straps 1310 strapping around the buoyant member. Upper end 25 of pole member 103 may be directly connected, at 1312, to strap 1310 or to bridge element 1311 connecting straps elements 1310. In this arrangement, pole member 103 can be considered to be rigidly connected to buoyant member 108. However, other connection types which allows for limited movement between the connected pole member and buoyant member are not excluded.

Figure 13C:
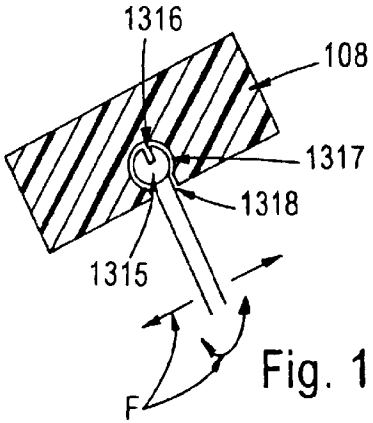
Figure 13B:
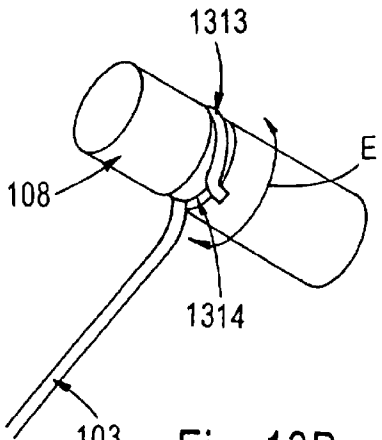

For instance, in FIG. 13B, upper end 25 of pole member 103 may be bent to have a hook shape 1313. Hook 1313 preferably conforms in size and shape with a circumferential surface of buoyant member 108 to which the hook is to be attached. Assuming that the circumferential surface of buoyant member 108 is cylindrical and the hook describes a circular arc, the hook can be fit to rotate around the buoyant member in directions of arrow E. In order to prevent hook 1313 from sliding in the longitudinal direction of buoyant member 108, a circumferential groove 1314 is provided on buoyant member 108. Hook 1313 is rotatably received in and retained by the groove. This arrangement is useful when buoyant members 108 are also rotatable around an axis as illustrated in FIG. 7 to facilitate passing movement of heavy debris under float line 106.

FIG. 13C shows a different type of moveable connection between pole member 103 and buoyant member 108. In this example, pole member 103 has enlarged end portion 1315 which is press-fitted into and moveably retained by cavity 1317 formed in buoyant member 108. Enlarged end portion 1315 is provided with a slit 1316 which makes the enlarged end portion at least inwardly flexible thereby allowing the press-fit engagement between the enlarged end portion and cavity 1317 of the buoyant member. Depending on the size and shape of opening 1318 and the corresponding portion pole member 103, pole member 103 may be allowed to move in various directions as shown by arrows F.

Figure 13D:
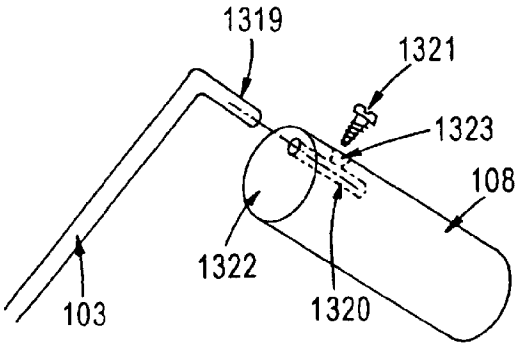

FIG. 13D, shows yet another embodiment of connection 210. In this arrangement, pole member 103 has an angled end portion designated as 1319 which is insertable into first hole 1320 formed in end face 1322 of the body of buoyant member 108. Pole member 103 and buoyant member 108 are fastened together by a fastening element, i.e. a screw extending through second hole 1323 formed in a circumferential face of the body of buoyant member 108. Depending on how tightly screw 1321 is fastened to angled end portion 1319 of pole member 103, a rigid, i.e. immovable, or moveable connection of the pole member to the buoyant member may be effected.

Figure 13F:
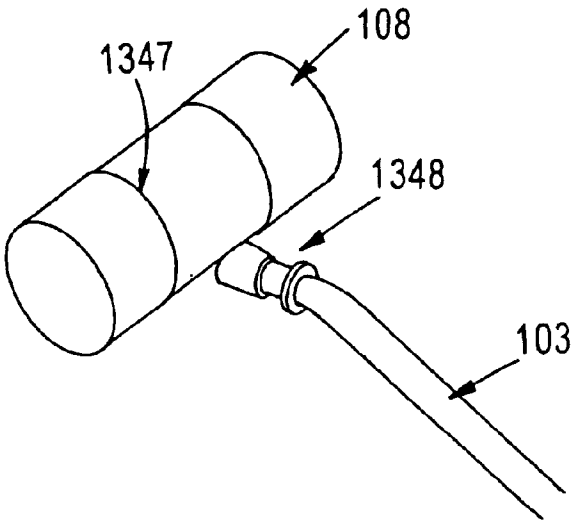
Figure 13E:
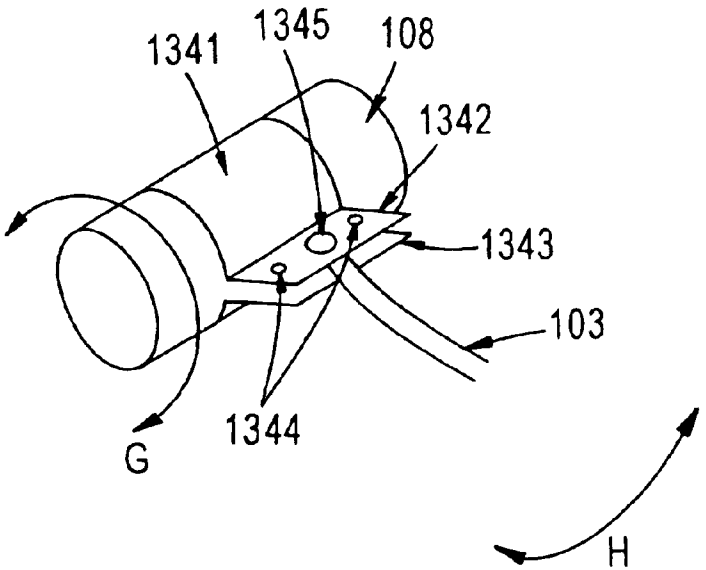
Figure 23:
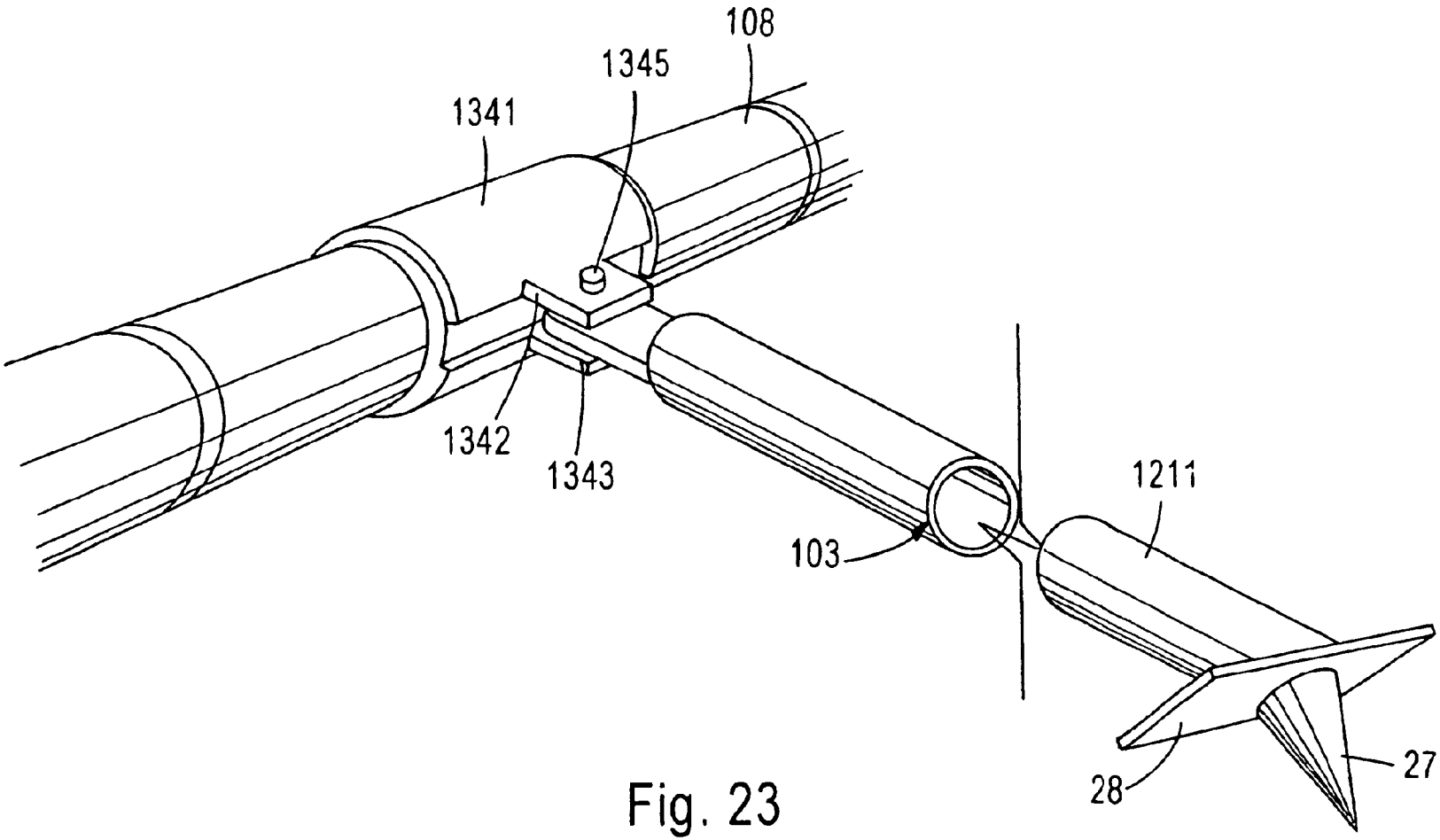
FIG. 23 is a perspective view showing a connection similar to FIG. 13E.

FIG. 13E depicts another embodiment of connection 210. Connection 210 in this embodiment comprises mounting sleeve 1341 extending circumferentially of buoyant member 108 for less than 360°. The ends of mounting sleeve 1341 are formed as attachment flanges 1342, 1343 extending radially outwardly. The flanges are fastened together by e.g. bolts or screws 1344. Depending on how tightly screws 1344 are fastened, mounting sleeve 1341 may or may not pivot about buoyant member 108 (see arrows G). It is within the scope of the present invention to provide buoyant member 108 with a shallow groove (not shown), similar to groove 1314 in FIG. 13B, in which mounting sleeve 1341 is received. Upper end 25 of pole member 103 is connected to attachment flanges 1342 and 1343 at 1345. For example, the upper end of pole member 103, and attachment flanges 1342 and 1343 are provided with aligned holes (not shown). Bolt 1345 extends through the holes and is fastened by a nut (not shown) to attach pole member 103 to mounting sleeve 1341. It is within the scope of the present invention that the hole of pole member 103 is slightly larger in diameter than bolt 1345, thereby allowing pole member 103 to pivot about bolt 1345 in the directions of arrows H. A similar structure is shown in FIG. 23.

FIG. 13F illustrates yet another embodiment of connection 210. This embodiment includes sleeve 1347 which extends circumferentially of buoyant members 108 for full 360° and is made from a flexible and stretchable material such as plastic or rubber. Sleeve 1347 is tightly strained around buoyant member 108. Sleeve 1347 is preferably formed integral with flexible connector 1348 which is advantageously made from the same material as sleeve 1347. Flexible connector 1348 is preferably made hollow and tightly strained around the upper end 25 of pole member 103. Thus, pole member 103 is connected to buoyant member 108 via flexible and stretchable member 1347/1348. The flexibility of connector 1348 allows for limited three dimensional movement of pole member 103 with respect to buoyant member 108.

Figure 14A:
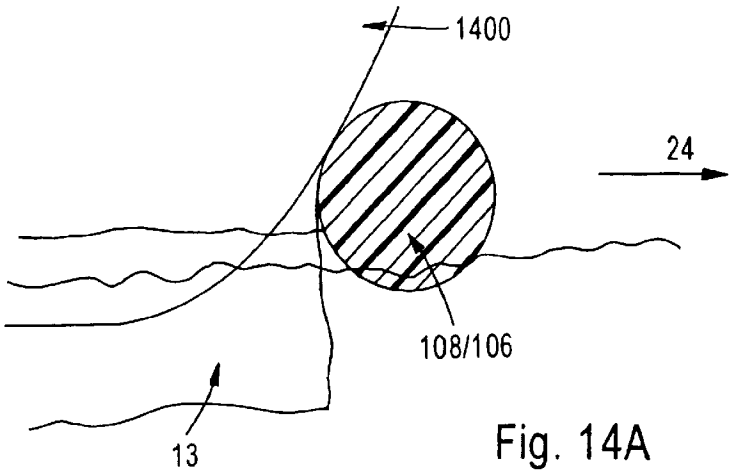
FIGS. 14A–14B show various cross sections of the float line of the present invention.
Figure 14B:
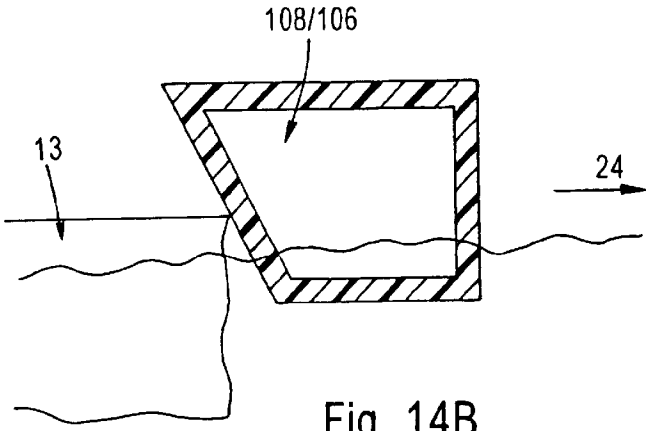

FIGS. 14A and 14B illustrate exemplary configurations for a buoyant member of float line 106. Preferably, buoyant members 108 have a circular cross section as shown in FIG. 14A. However, buoyant members 108 may have a multisided cross section as shown in FIG. 14B. It is desirable to configure the front side of the multisided buoyant members which faces the river current as a planar surface slanted at an angle with respect to flowing direction 24, as can be seen in FIG. 14B. In this arrangement, the buoyant member in particular and the whole float line in general will be easily lifted when heavy floating object 13 hits the slanted surface of the buoyant member.

It should be noted that the skimmer of the present invention does not obstruct waterway traffic along the river. When a boat 1440 (FIG. 14A) hits float line 106, the float line will be pressed down to allow the boat to go over it. However, when a large floating object which is mostly submerged hits float line 106, the line will be raised in the sliding and pole-vaulted manners described above.

Another preferred embodiment of the present invention will be described herein below with reference to FIGS. 16–22.

The object of this preferred embodiment is to maintain the skimmer float line 106, as it stretches across the flowing stream, in a relatively straight position. As one can imagine, the stream current pressure against the float line 106 will be considerable when the water level is high. Two methods are devised to maintain the float line 106 in its taut position. The simplest method is to attach a quasi floating object (like a log 2407 in FIG. 24 that will be described herein below in greater detail) to, e.g., the downstream end 112 of the float line 106, dangling it down stream. Pulled by the streams currents, this log 2407 should keep the float line 106 taut. If this method does not provide enough tension against the float line 106, the float line 106 can be attached at both ends, i.e., the upstream end 111 and downstream end 112 to the floating object (i.e., log 1607 in FIG. 16), so that the log 1607 is in a sideways position to the current (best seen in FIG. 18) so as to catch the full force of the stream's current.

Like the above described embodiments, the resilience of the device in this embodiment is in its ability to give way to the stress when bombarded with the heavy trash. The device survives much like a willow tree in the wind, by accommodating the heavy stress conditions. When bombarded with heavy debris, the skimming float line is pulled out of the water by that debris, allowing the debris to un-snag and pass underneath without damaging the device. Once the heavy debris has passed, the float line will fall back in place in the water and be pulled back to its original relatively straight position by the tension of the dragging log (2407 or 1607) so that it can continue skimming the light floating trash. Similar to the above described embodiments, the collection net 107, so as to collect the debris, is preferably attached to the downstream structural end post 1702 and to a steel stake 1712 (FIG. 17) located at the high water level mark of the nearside.

For the float line of the present invention to function properly, the site area selected should be sufficiently deep so that the water surface is not turbulent. For this reason, the choice of the site is important. For this preferred embodiment, the site should be a pool area along the stream which has gradual beach embankments on both sides. The non turbulent pool area of the stream insures that the float line skimmer is completely effective. Still, a gradual beach embankment condition may not always be possible. Therefore, two stream bank conditions are herein addressed: 1) a gradual beach embankment and 2) a wall embankment.

With a gradual beach embankment condition, a track on an end post 1702 (FIG. 17), connected to float line skimmer 106, slides up and down the vertical extending end post 1702 with the rise or fall of the water level. A smaller opposite side upstream post 1855 (FIG. 18) is placed at the high water level mark. The weight of the float line 106 will keep the float line 106 at the varying water level. The gradual beach embankment will require only one end post 1702 with its slidable attachment. At the opposite upstream end 111, the float line 106 (extending across the stream) extends out of the water to a point at the highest water level mark on the embankment where the smaller end post 1855 is anchored.

Figure 19A:
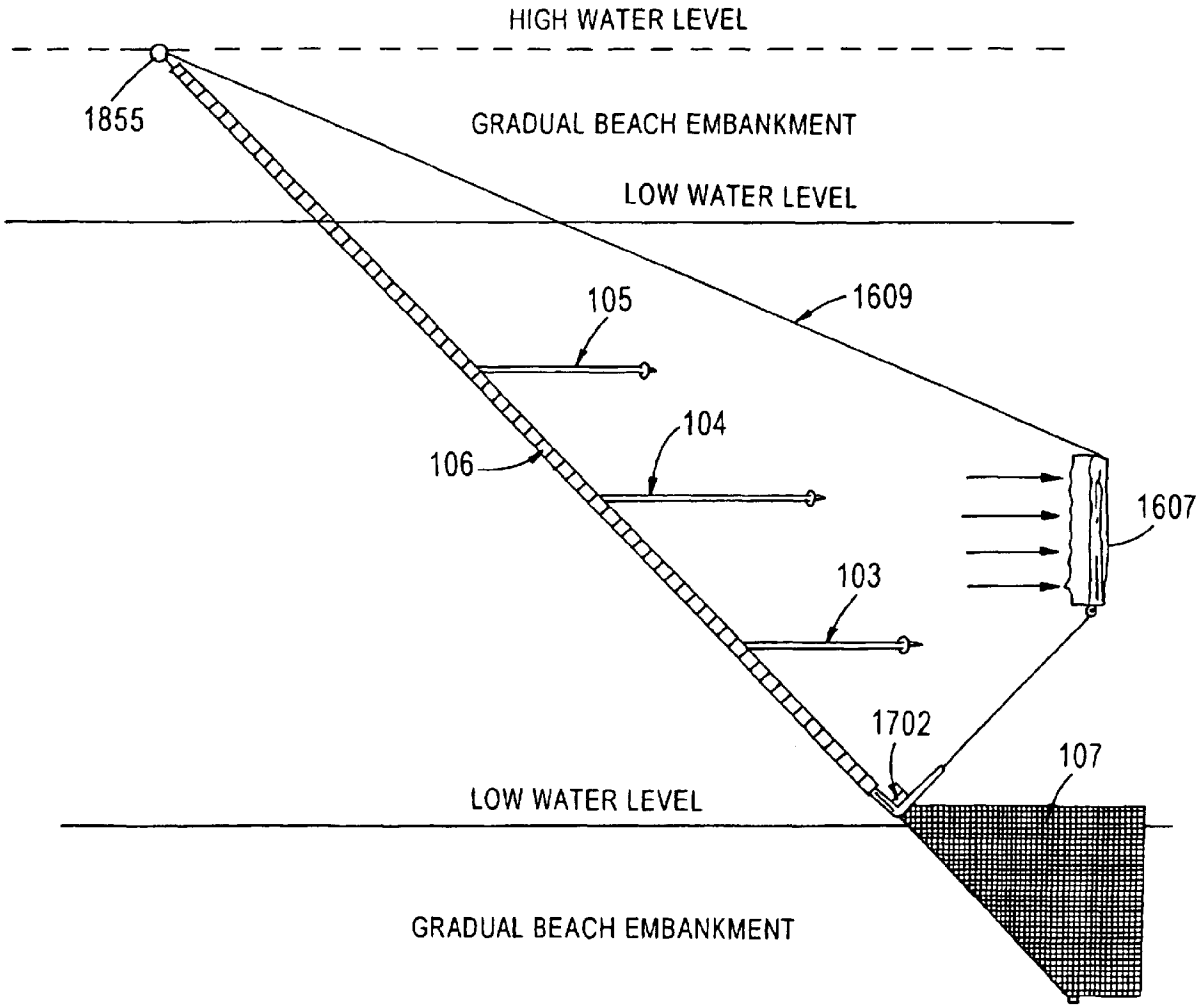
FIGS. 19A–19C are schematic top plan views showing the operation of the floating river debris skimmer of FIG. 16.
Figure 19B:
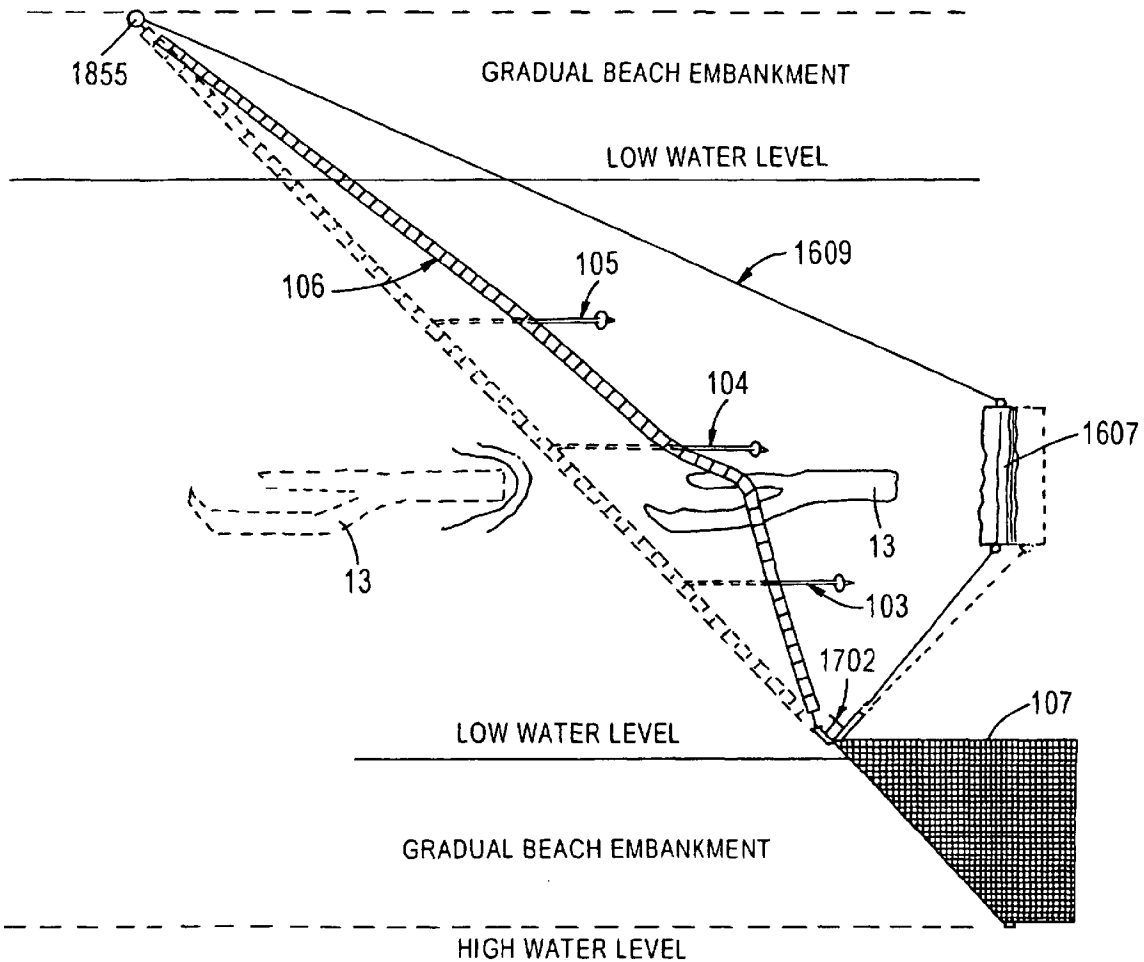
Figure 19C:
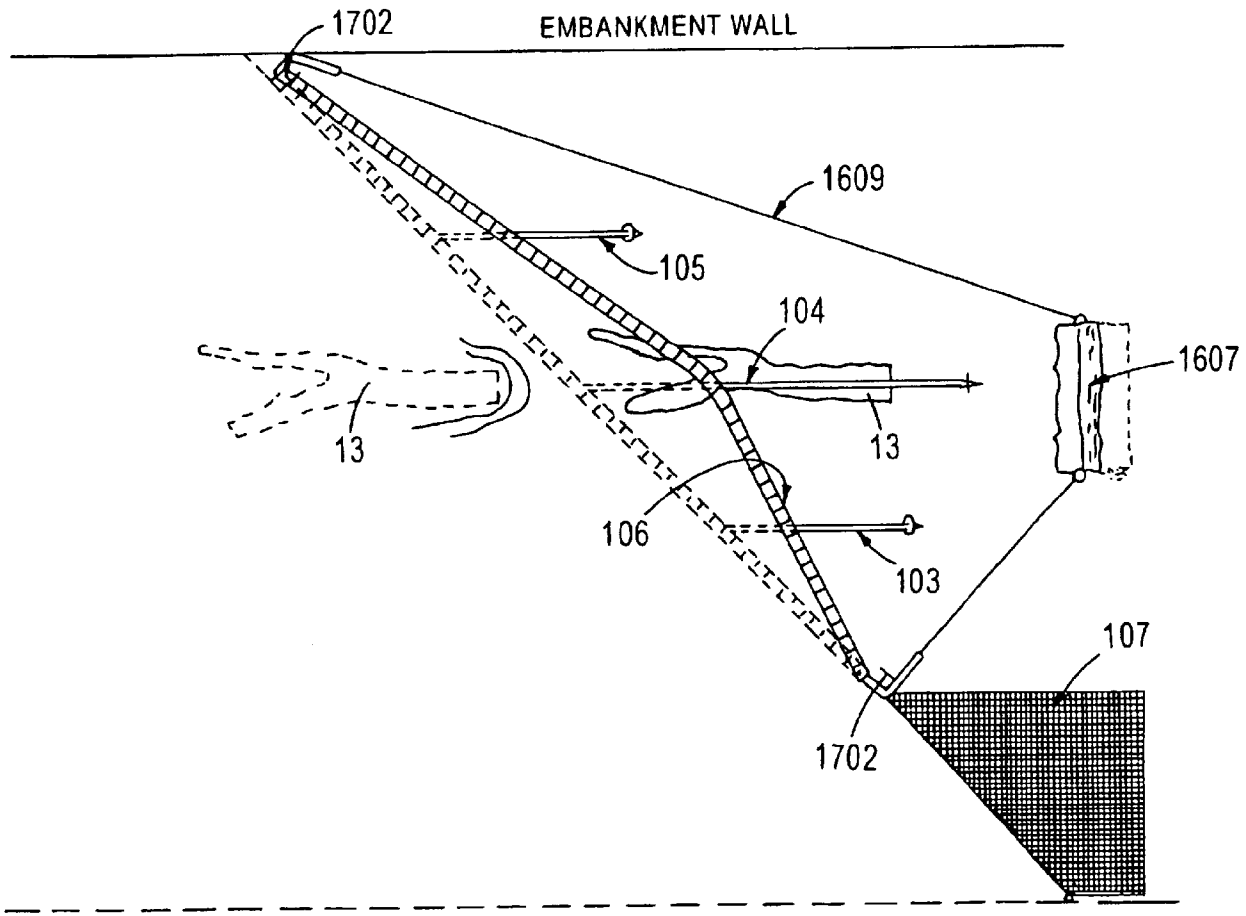
Figure 20:
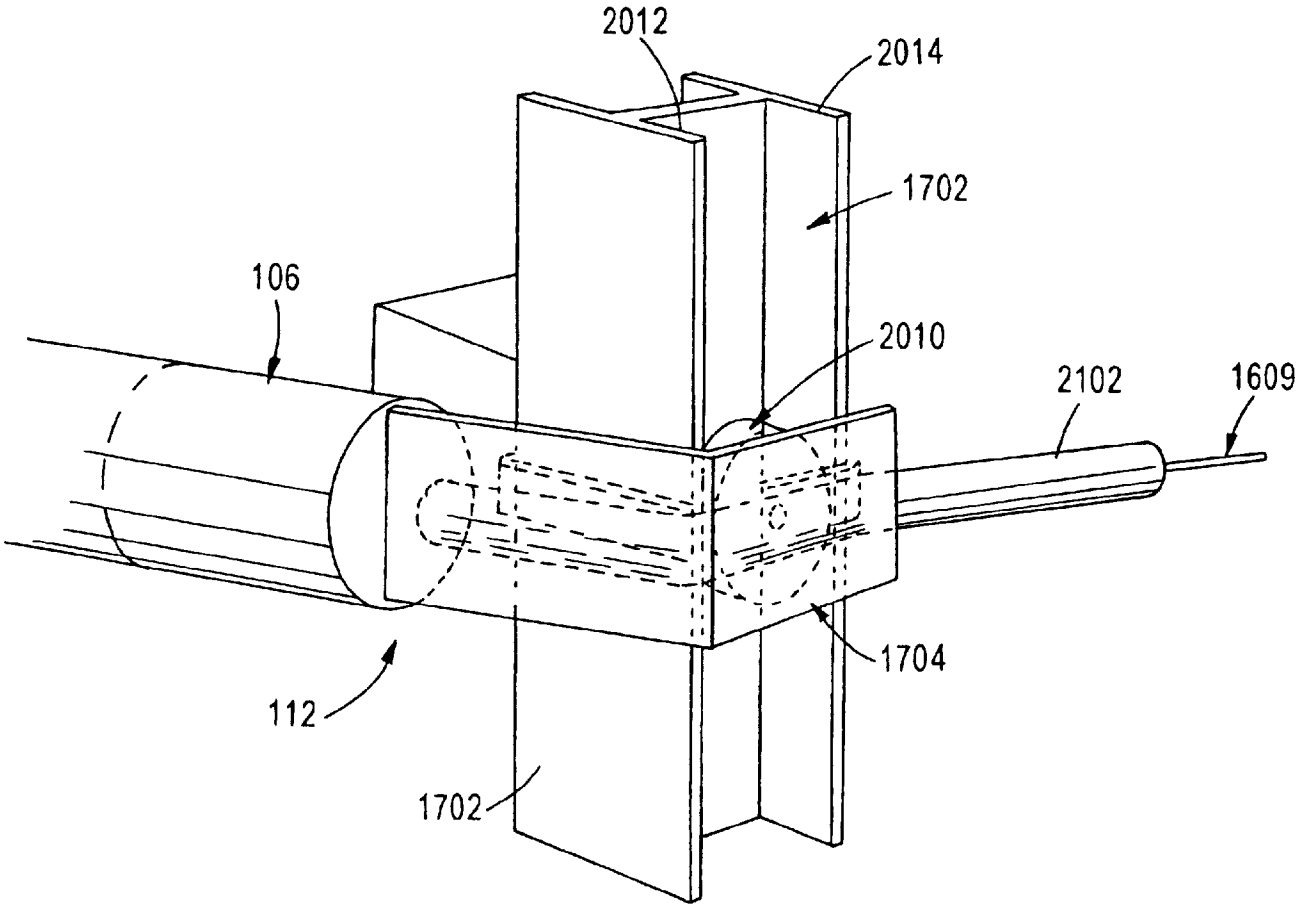
FIG. 20 is a fragmental perspective view of the end of the floating river debris skimmer shown in FIG. 17.
Figure 21A:
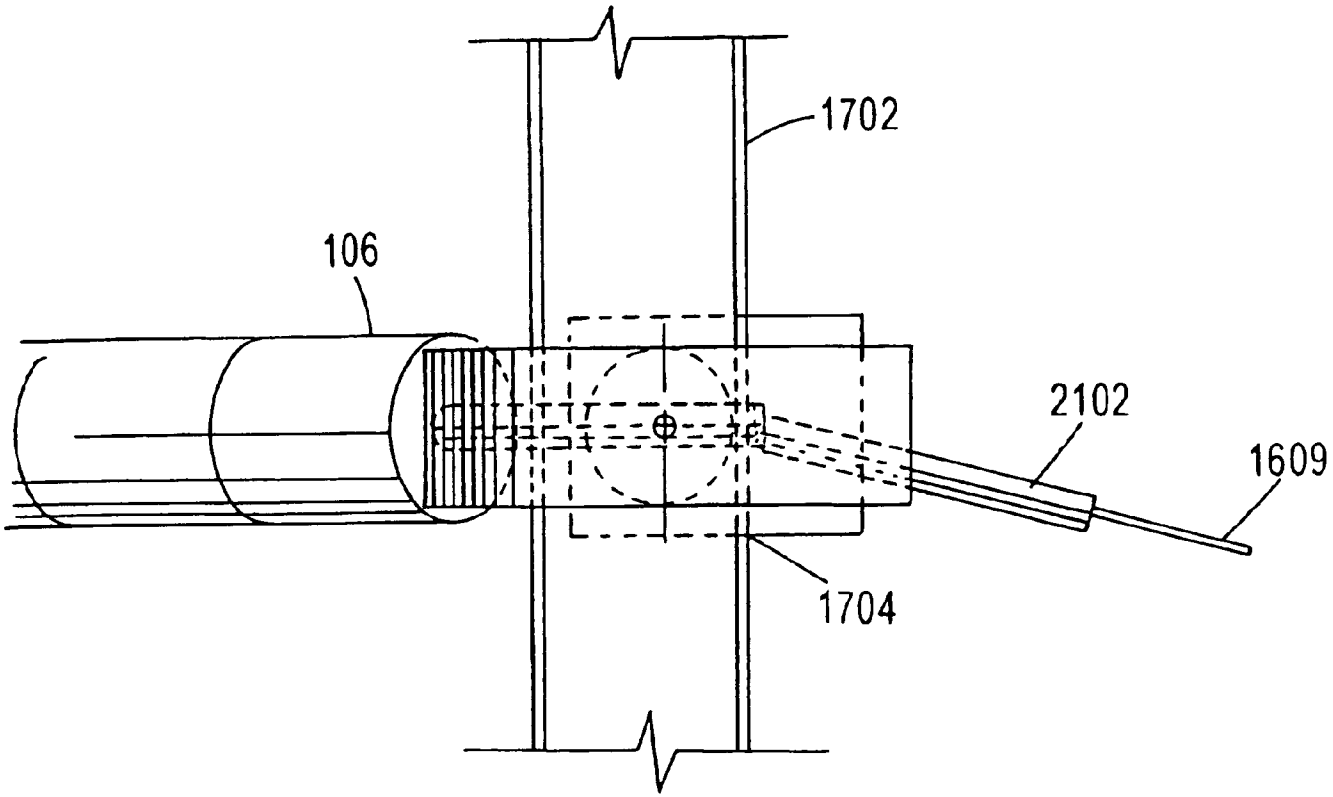
FIGS. 21A–21B are schematic front and rear views of FIG. 20.

If a wall embankment condition exists, two end posts 1702 with slidable attachments at both ends 111 and 112 of the float line 106 are required, as shown in FIG. 19C.

The end posts 1702 is preferably made of a non-corrosive material, such as stainless steel, and robust enough to withstand rugged abuse. Some stream beds are comprised of solid rock. To penetrate the rock, a hole must be drilled into the bed of the stream, creating a foundation for the end post 1702. In any case, the stainless steel structural post must be driven into the stream bed using a pile driver. The structural post 1702 must be driven as deeply as is necessary to insure that the post 1720 will be stable under the heavy stress conditions of the stream current and debris. When stream beds are of mud or lose material, the structural post 1702 can be driven as deeply as is necessary to insure that the post is stable under the heavy stress of the stream current and debris.

Figure 16:
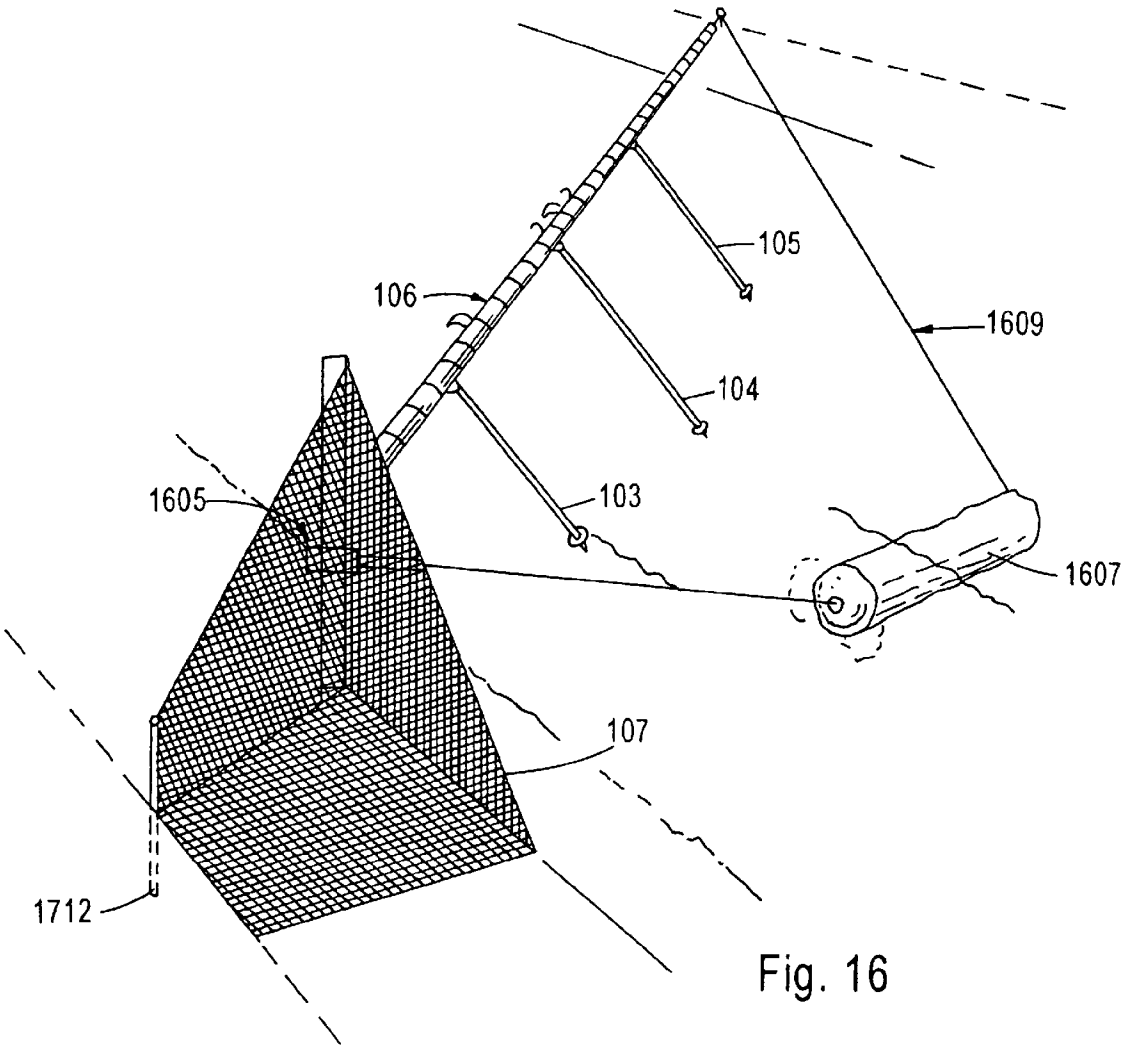
FIG. 16 is a perspective view showing a floating river debris skimmer which is equipped with a submerged log in accordance with another embodiment of the present invention.
Figure 17:
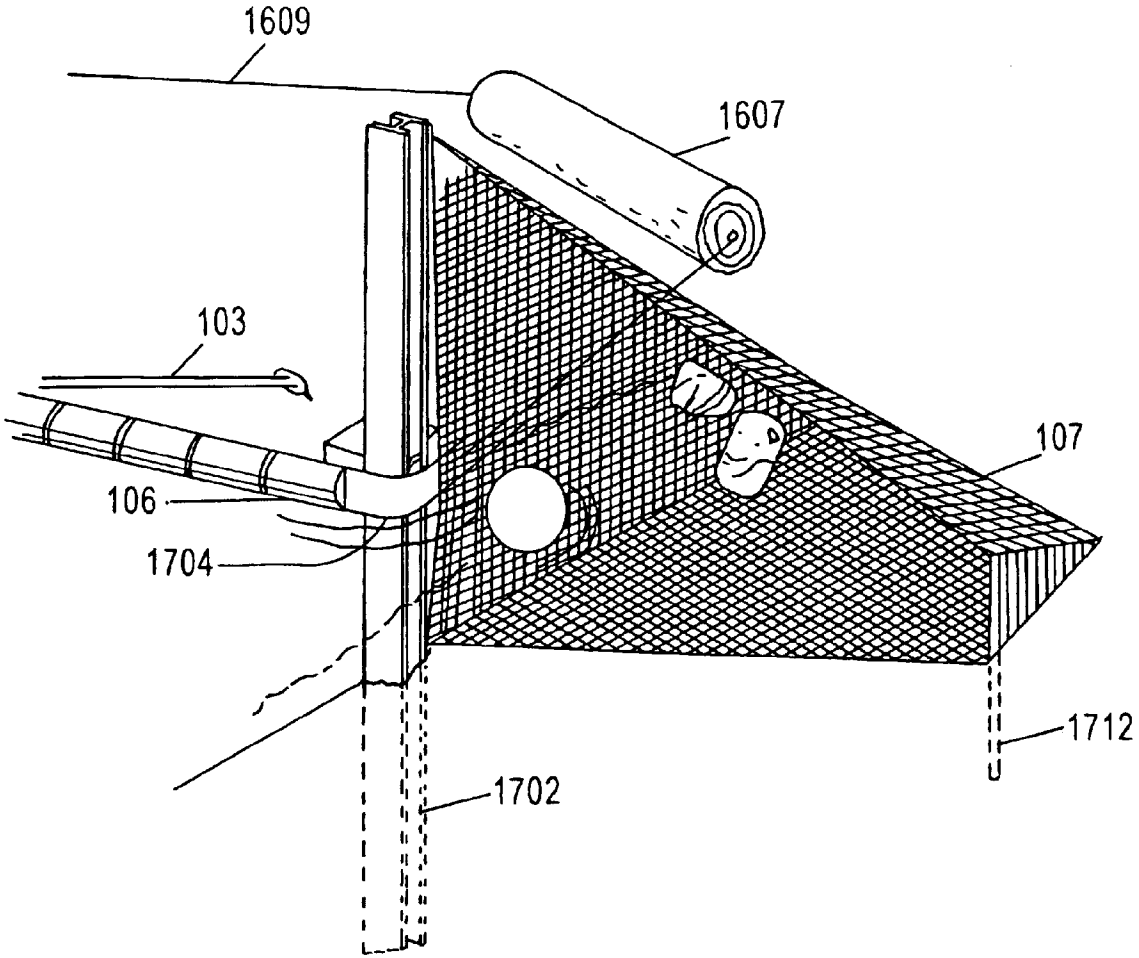
FIG. 17 is a fragmental perspective view of one end of the floating river debris skimmer of FIG. 16.
Figure 18:
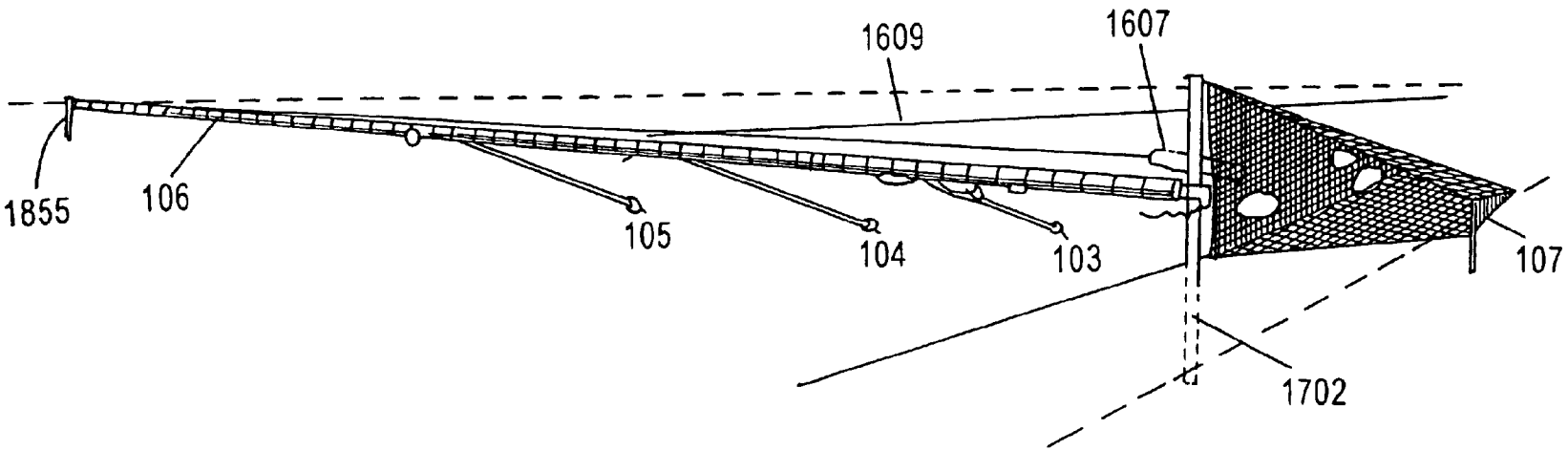
FIG. 18 is another perspective view of the floating river debris skimmer of FIG. 16.

FIG. 19A shows the skimmer of the preferred embodiment of FIG. 16 with log 1607 in a skimming operation. In FIGS. 19B and 19C, when a heavy object, i.e., floating tree 13, snags onto the line 106, the line is pulled up out of the water, e.g., as high as five feet, un-snagging the object 13 from the float line 106. In this un-snagging operation, the log 1607 moves from the original position (FIG. 19A and phantom line in FIGS. 19B–C) to the temporary positions as shown in FIGS. 19B–C as the cable 1609 attaching log 1607 to posts 1702 and/or 1855 is pulled. As can be seen in FIG. 19B, since the upstream end 111 of float line 106 is fixed to post 1855, the float line 106 is raised locally, i.e., mostly between pole members 103 and 104 where tree 13 hits the line. However, when both upstream end 111 and downstream end 112 of float line 106 are slidably attached to posts 1702 as shown in FIG. 19C, the entire line 106 is raised as illustrated and described above with respect to FIG. 4.

A slidable pulley like device 1704 (best seen in FIGS. 20 and 21A–B), which normally maintains the float line 106 at the water level, also allows the cable/rope connection at the end post 1702 to slide up to assist in un-snagging action of the line 106. When the object 13 is freed, the line 106 slides back down allowing the float line to reseat in its original position at the water level. The float line 106 will be pulled taut, reseating back into its original position, by the pull of log 1607 dragged by the stream current. The more rapid the current against the float line 106, the greater the drag of the log 1607, and vice versa.

Figure 22:
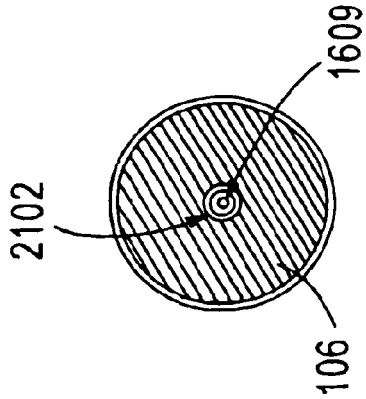
FIG. 22 is a cross section view of the float line shown in FIGS. 20 and 21A–21B.
Figure 21B:
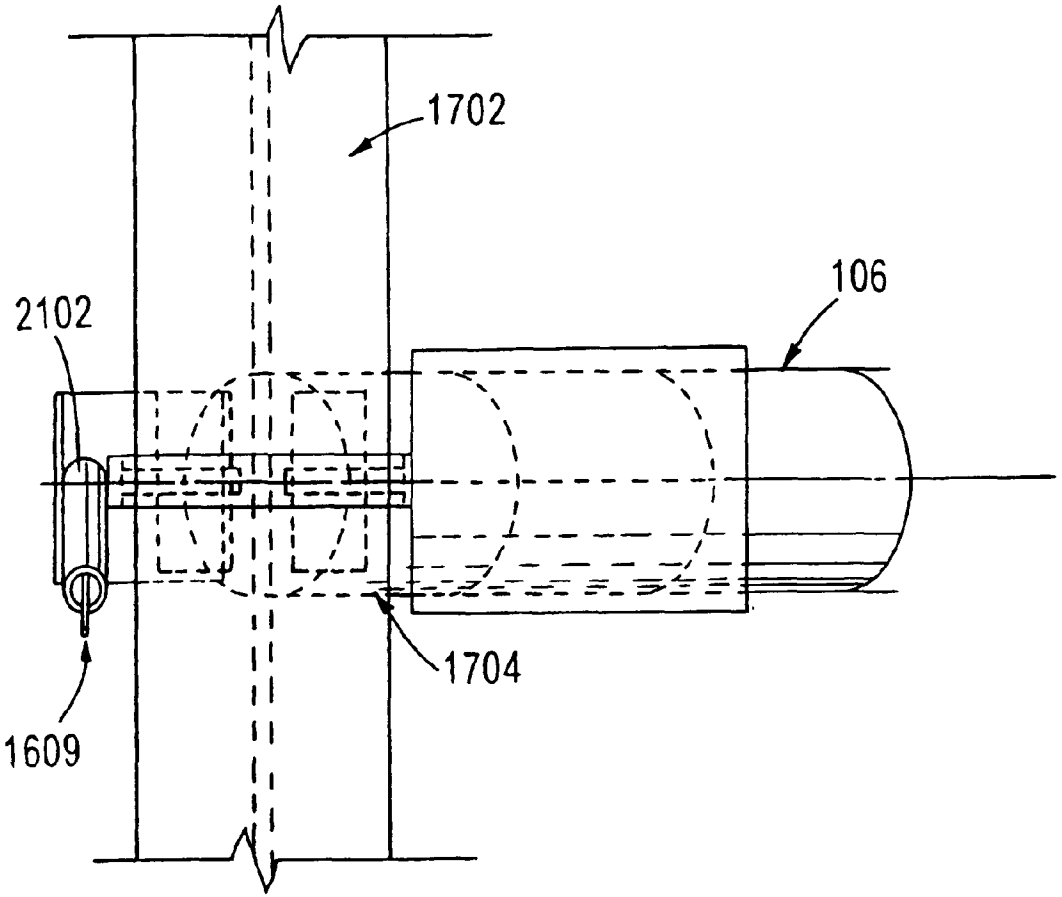

Slidable pulley like device 1704 preferably includes wheel 2010 moveable along and retained between opposite walls 2012 and 2014 of I-shaped post 1702 so that downstream end 112 of float line 106 attached to the slidable pulley like device 1704 can move up or down together with the water level and during the un-snagging operation. A protective tube or pipe 2102 is provided to protect cable 1609 from being chafed. Preferably, cable 1609 extends through float line 106, as illustrated in FIGS. 7 and 22.

The major expense in the installation is driving into place the end posts 1702. A heavy pneumatic pile driver will be used to pound the end post deep into the bed of the stream. Beyond this task, installation is very easy. In preparation for assembly, the float line 106 is laid out on the ground near the site and the pole vaults 103–105 clamped to the float line 106. After assemblage, cable 1609 of float line 106 is then stretched across the stream, hooked around the end posts 1702/1855 and attached to the dragging log 1607. The net 107 is then attached to the downstream nearside end post 1702 and to a stake 1712 at the near side high water mark. The skimmer is then ready for operation.

Another preferred embodiment of the present invention will be described herein below with reference to FIGS. 24–26.

Figure 24:
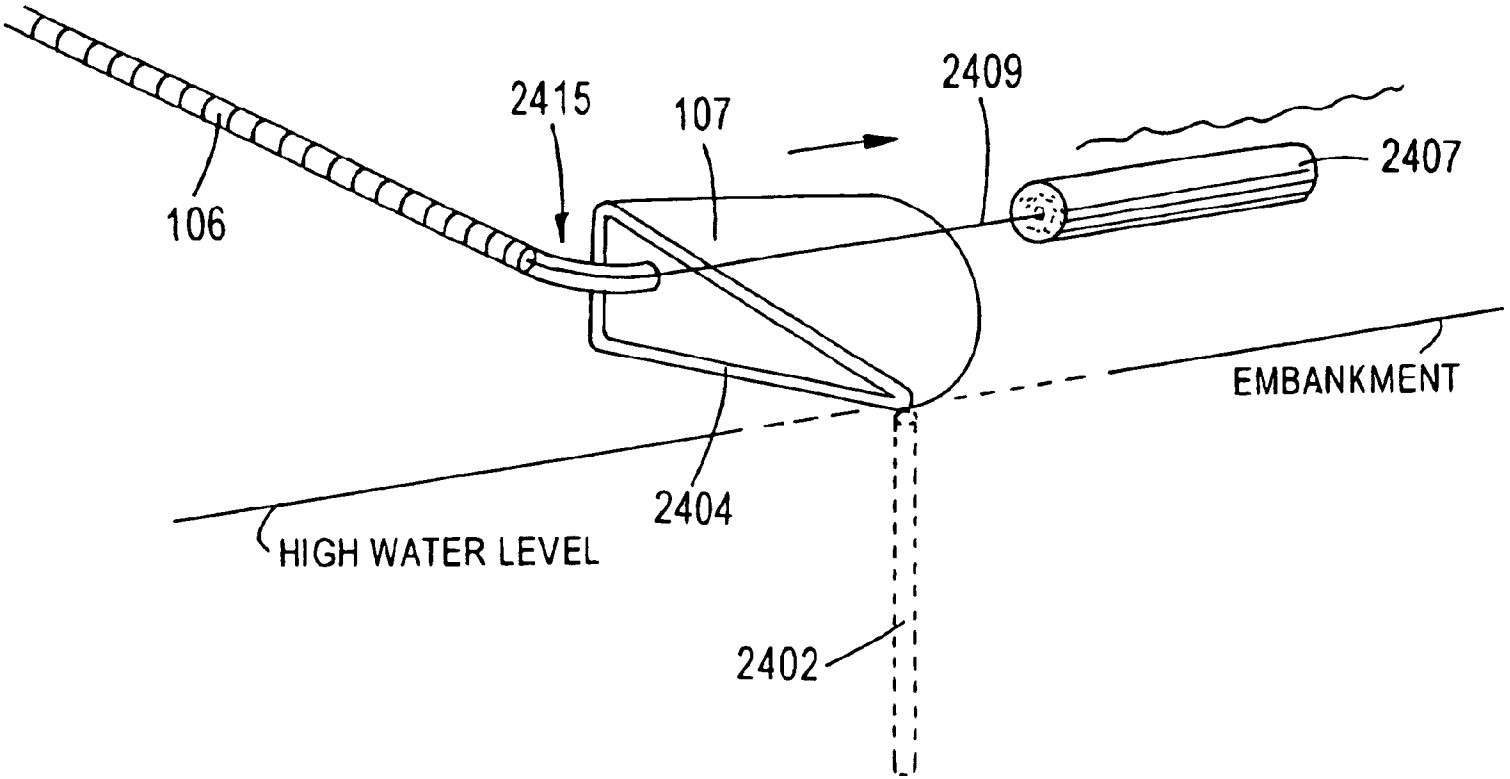
FIG. 24 is a perspective view showing another embodiment of the present invention which uses a swiveling net.
Figure 25:
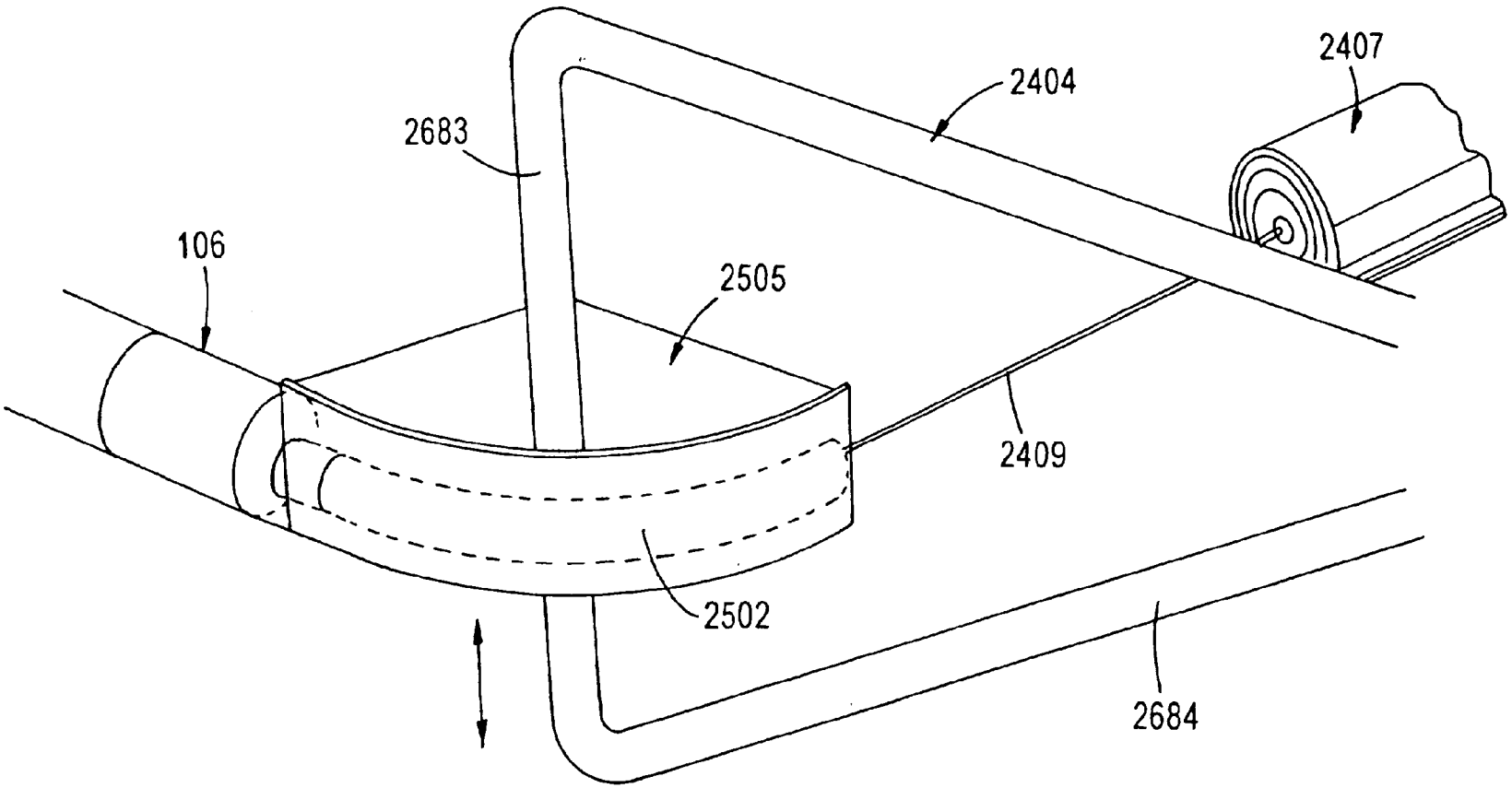
FIG. 25 is a fragmental perspective view of FIG. 24.

In FIGS. 24–25, as explained above, the float line 106 is kept taut simply by the pull of a log 2407 dragged by the stream current. The more rapid the current against the float line 106, the greater the drag of the log 2407, and vice versa, allowing the float line 106 to fall with the lowering water surface. The submerged log 2407 can be dangled behind the float/pulley like apparatus 2415 either up and down the stream current or sideways depending on the amount tension required to keep the float line 106 taut. The log can be painted with sealant to preserve it.

Unlike the above described embodiments where the net 107 is fixed to the river bank, the net in this embodiment is moveable relative to the river bank. It has been observed that the wall like embankment condition makes removal of the collector net more difficult since its access will not be on a receding beach like shore. To overcome this disadvantage, the net 107 is preferably placed at the high water mark level. As shown in FIGS. 24 and 26, net 107 is attached to the triangular shaped rim 2404 which swivels on the stainless steel post 2402 driven into the stream bed along the edge of the high water mark. A large float 2612 is attached to the vertically extending side 2683 of the triangle 2404 at or near the base 2684 so that the triangular frame 2404 can swivel up and down, about swivel 2617 positioned on the top of post 2402, with the changing water levels. The triangle 2404 will swivel out from the top of post 2402 at the high water mark post at a predetermined angle, e.g., of 22.5°, allowing the vector of the floating log to fully act to maintain maximum tension on the float line 106. the triangle 2404 is preferably right-angled as best seen in FIG. 26.

The structural post 2402 should be very resilient so as to handle the forces caused by the combined stress of the float line 106 and its tenser means, the dragging log 2407. Also, its action needs to accommodate the movement when the float line 106 is pulled out of the water by the tug of a snagging log 13 and when the float weight slides back into its normal position, re-tensing the float line 106 and pulling the apparatus back into its normal position after the trauma of accommodating the heavy debris.

The float/pulley like apparatus 2415 is depicted in detail in FIG. 25 to include pulley like track pipe 2502 which protects cable 2409 connected to log 2407 from being chafed. Again, cable 2409 preferably extends through float line 106 as shown in FIG. 7. A float 2505 is attached to side 2683 of triangle 2404 forcing the triangle 2404 to swivel up and down with the water level.

Figure 26:
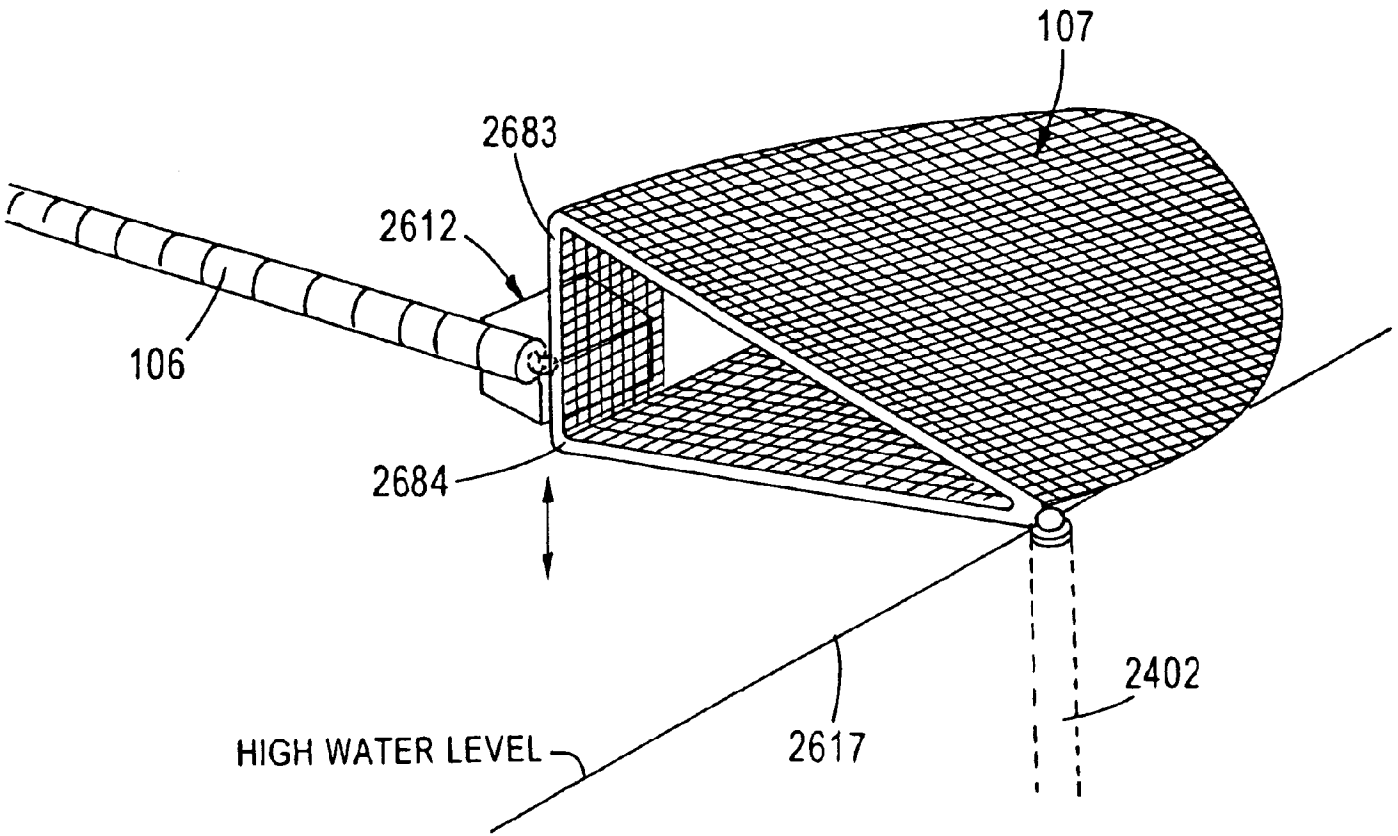
FIG. 26 is a perspective view showing an embodiment using a swiveling net similar to FIG. 24.

In the embodiment of FIG. 26, the log 2407 or any other float line tensioning means is omitted. Downstream end 112 of float line 106 is attached to side 2683 of triangle 2404 either fixedly or moveably. Again, float 2505 is fixed to side 2683 of triangle 2404, forcing the triangle 2404 and net 107 to swivel up and down with the water level.

Figure 27A:
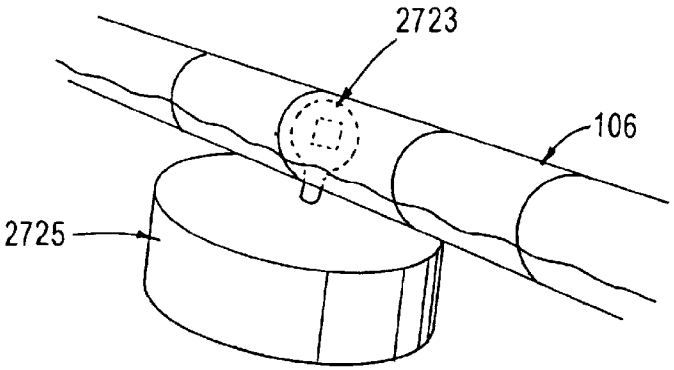
FIGS. 27A–27B are perspective views showing another embodiment of the invention with a surface anchor.
Figure 27B:
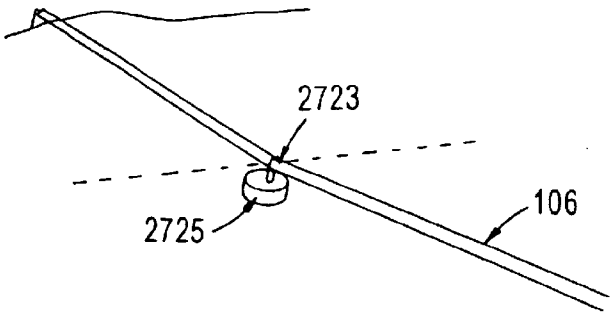

Another preferred embodiment of the present invention will be described herein below with reference to FIGS. 27A–B which show a surface anchor 2723 positioned in the middle of the float line 106. The surface anchor 2723 preferably includes a hollow tank 2725 filled with water to keep the float line 106 down against the water surface.

Another preferred embodiment of the present invention will be described herein below with reference to FIGS. 28–35.

Figure 28:
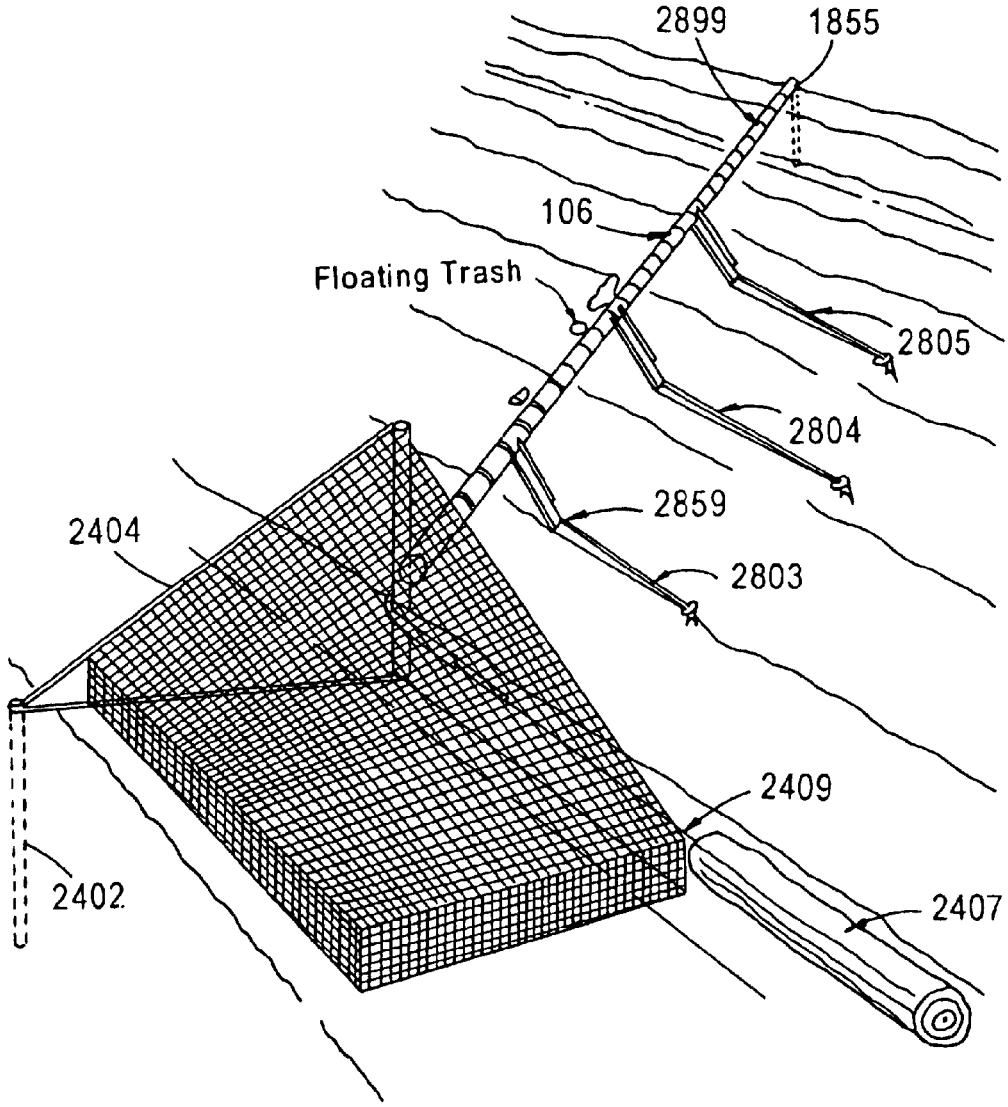
FIG. 28 is a perspective view showing another embodiment of the present invention which uses pole members having elbow joints and a float line cylinder.
Figure 29:
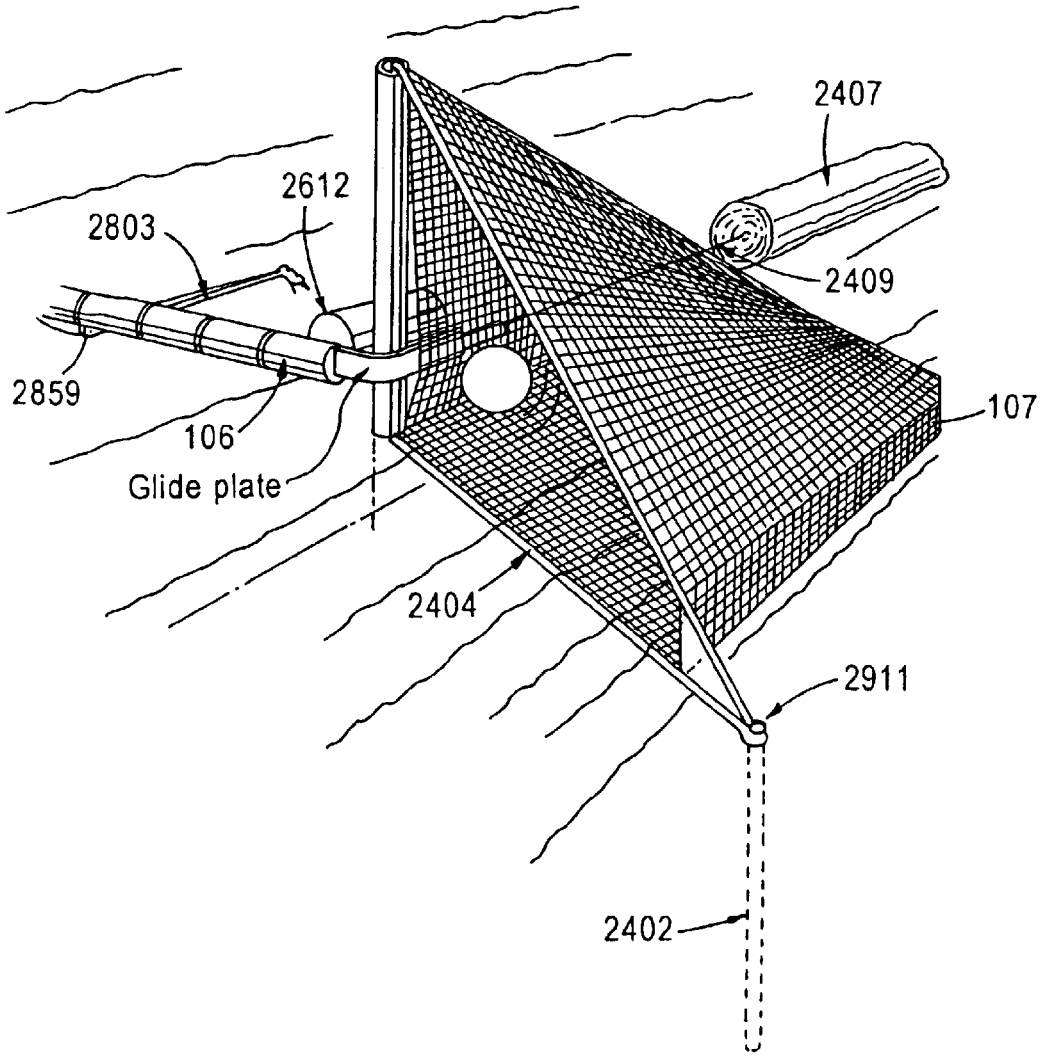
FIG. 29 is a fragmental perspective view of FIG. 28.

FIG. 28 shows a structure basically similar to FIG. 24. The major differences between the embodiments of FIGS. 24 and 28 are: (i) the pole members in the embodiment of FIG. 28 have elbow joints 2859 and (ii) a float line cylinder 2899 is incorporated in to the float line 106 at the upstream end 111. In addition, although, float 2612 is omitted from FIG. 28 for clarity, it is within the scope of the present invention to provide such a float as depicted in FIG. 29.

Figure 32:
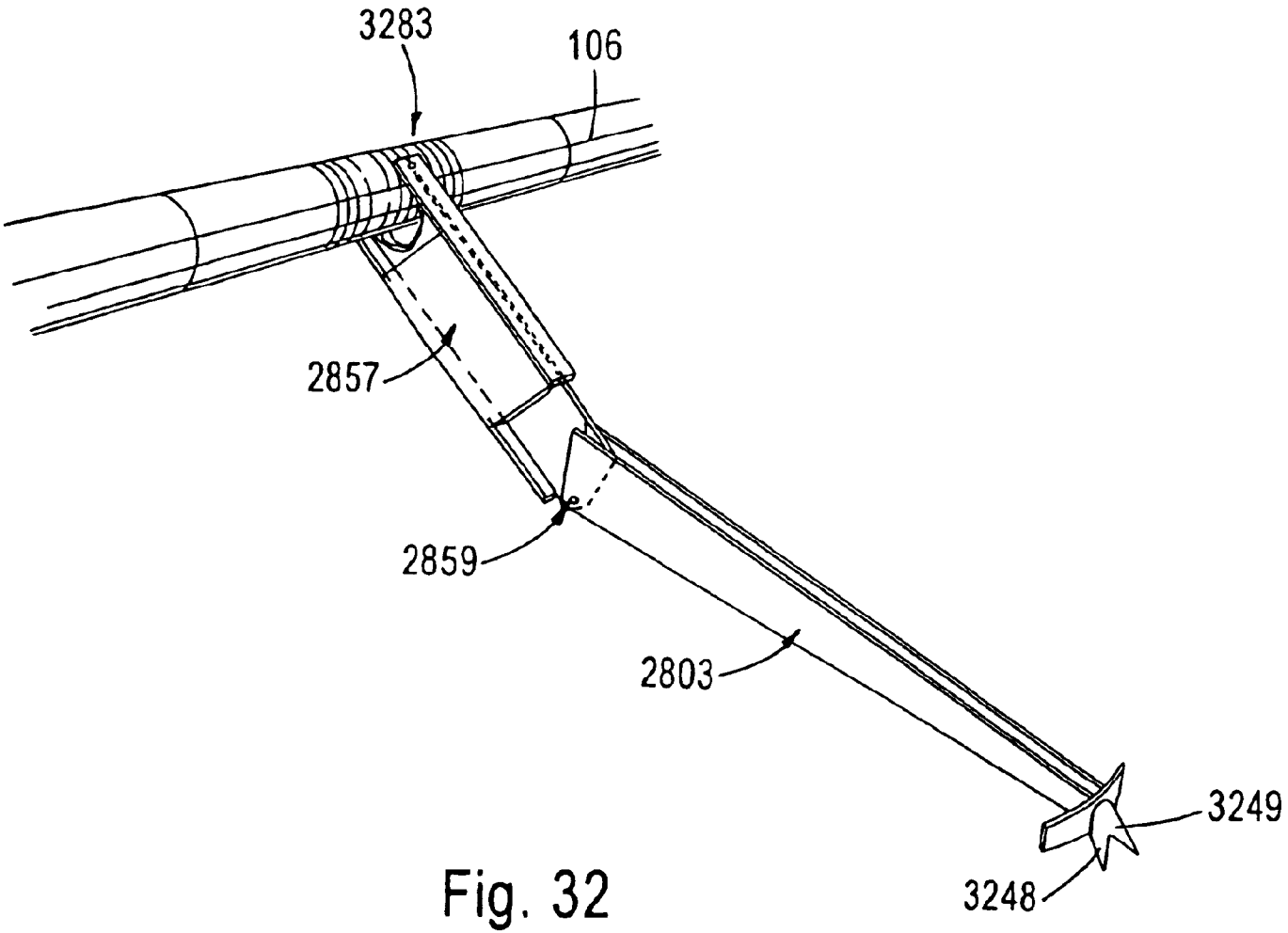
FIG. 32 is a fragmental perspective view showing the pole member having an elbow joint of FIG. 28.

Regarding the specific structure of the pole members 2803–2805, the elbow arm would provide better leverage in shallower water and is the preferred approach. Each pole member will have a foot attachment, e.g., as shown in FIG. 23, at its end to grab but not sink into on the bed of the stream. A variety of feet designs should be considered to meet various stream bed conditions, i.e., such as mud, small rock, large rock, gravel, or sand. In other words, the foot must address the specific bed condition, i.e., whether hard, soft, sticky, or chunky. The foot must hold and release easily. A two prong (3248, 3249) design approach is shown in FIG. 32 which would allow the foot to grab at varying angles.

Figure 29A:
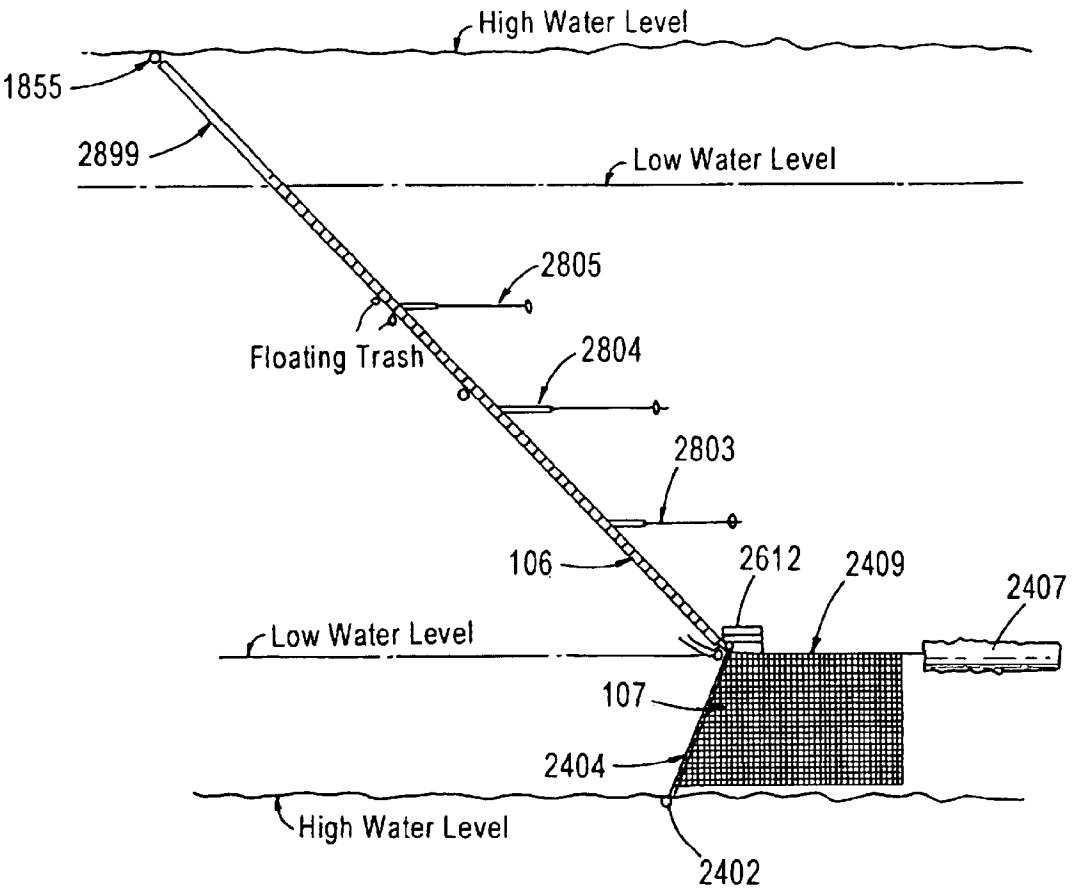
FIGS. 29A–29B are schematic top plan views showing the operation of the floating river debris skimmer of FIG. 28.
Figure 29B:
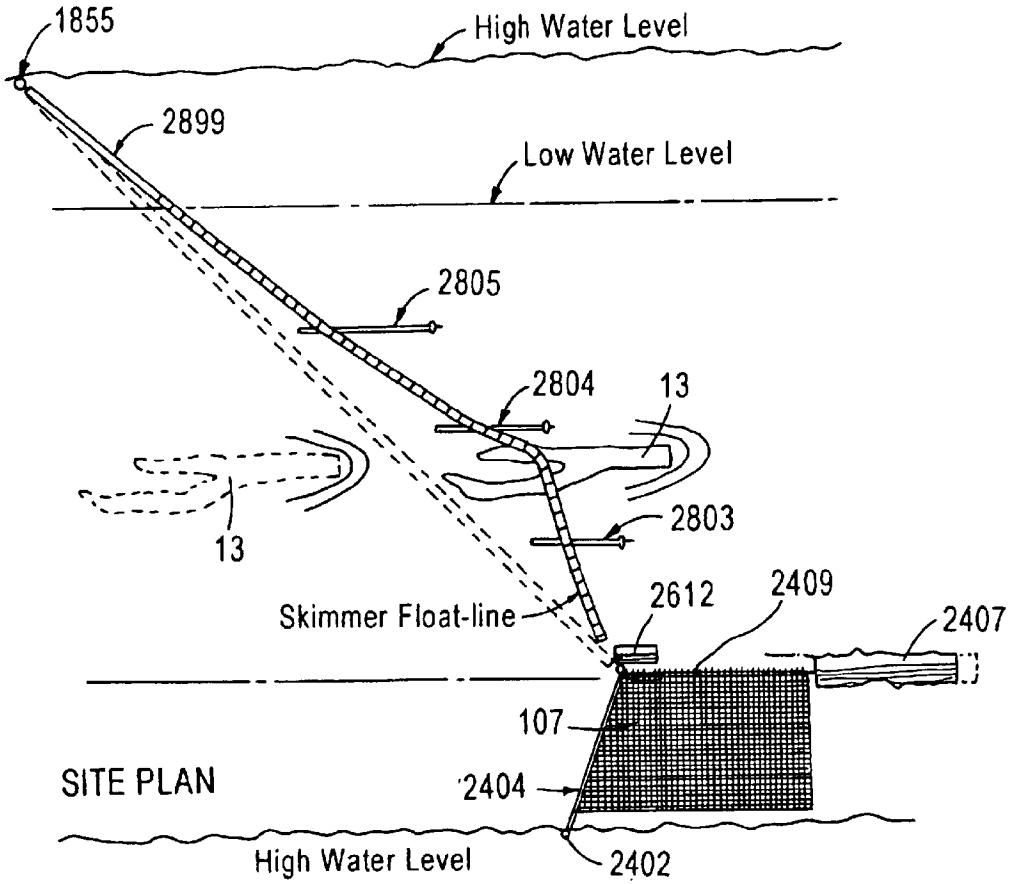
Figure 33:
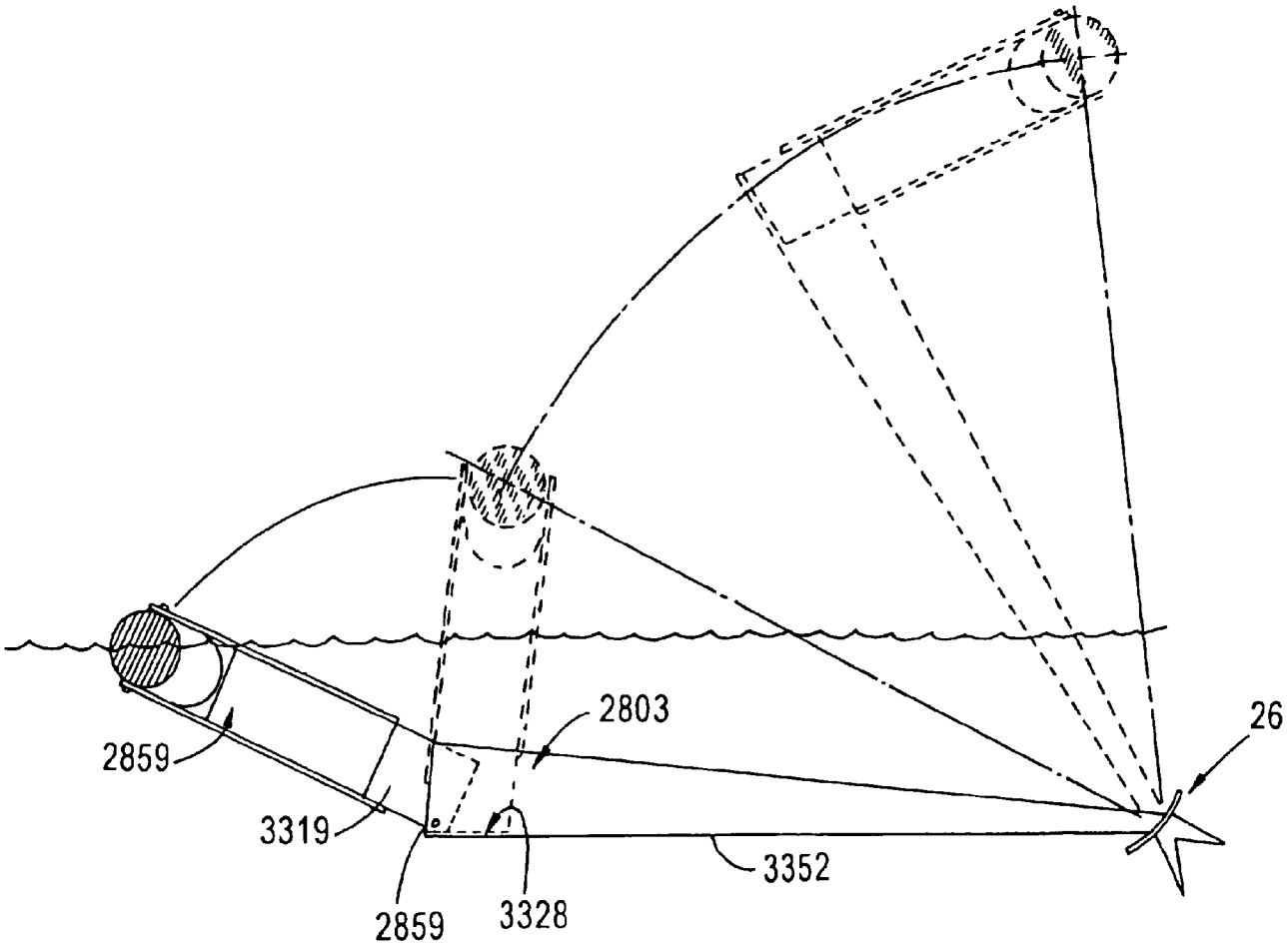
FIG. 33 is a schematic side view showing the pole member having an elbow joint of FIG. 32 in action.
Figure 34:
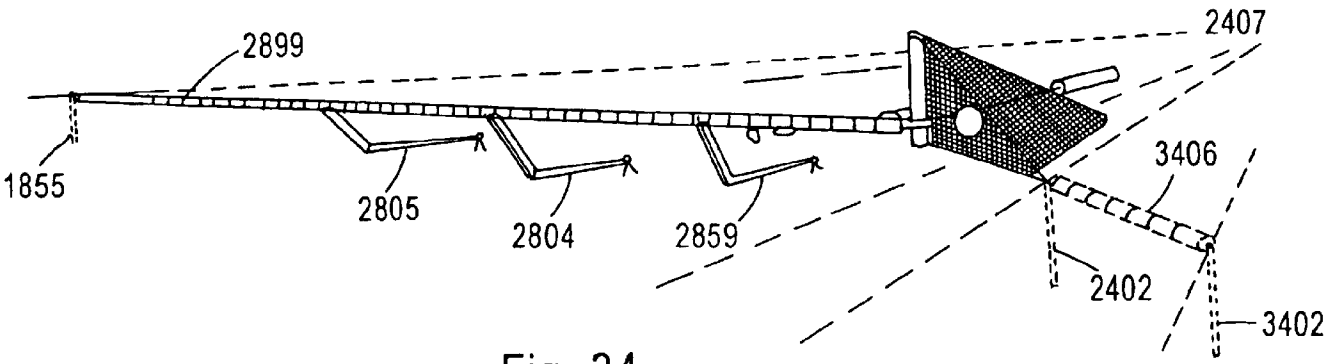
FIG. 34 is another perspective view of the floating river debris skimmer of FIG. 28.
Figure 35:
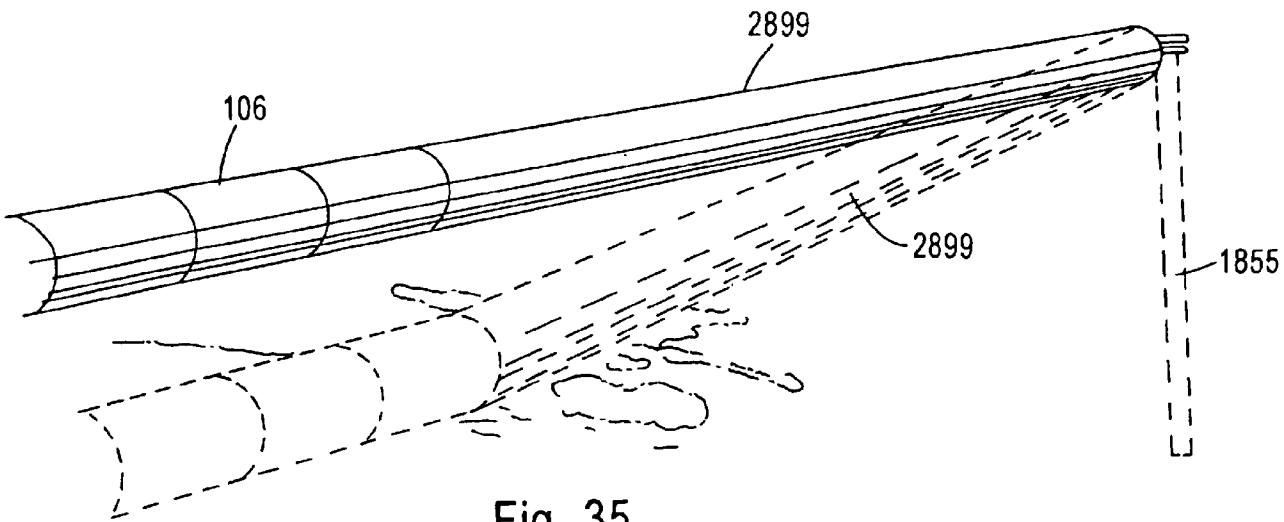
FIG. 35 is a fragmental perspective view showing the float line cylinder of FIG. 28.

Pole vaults or pole members 2803–2805 are connected along the line of skimmer floats using strap connectors 3283. The pole vaults should have varying lengths that will allow the float line 106 to rise above the water level, e.g., up to five feet, as determined by the depth of the water at its high water mark. The submerged foot of each pole vault must adapt to the streambed conditions. The arm of the pole vault may be designed with an elbow 2859 and, optionally float 2857 embedded into the arm, which allow(s) the float line 106 to be partially lifted out of the water (best seen in FIG. 33, the lower double-dash line) when the line is hit by a heavy floating object. When side 3328 of arm 3319 is stopped by the lower side of elongated member 3352, the arm 3319 can no longer pivot about joint 2859. Accordingly, the whole pole member, e.g., 2803, pivots about lower end 26 of the pole member as best seen in FIG. 33, the single-dash line. Thus, the leverage angle of the vaulting action is improved so that the vaulting mechanism can effectively lift the float line 106 out of the water. This arrangement will allow the float line 106 to be placed in water that is shallower. FIGS. 29A–B show the skimmer of this embodiment prior to and during the un-snagging action.

The joint connection 3283 between the pole vault 2803 and the float line 106 and at the elbow 2859 of the arm must be rugged and flexible. The feet of the pole vaults must be able to effectively grip the streambed without hanging up when forced by heavy debris to disengage. The poles must be light and yet as strong as possible.

Regarding the specific structure of the float line 106, a float cylinder 2899 (FIG. 35) is incorporated at the upstream end 111 of the line. The elongated cylindrical float 2899 keeps the float line 106 weighted down to accommodate the varying water levels. The length of the float 2899 is preferably the horizontal measurement between the high and low water marks at the upstream end 111, as best seen in FIGS. 29A–B. Thus, when the water level rises and falls, the skimmer float line 106 stays with the water level with the aid of the elongated float 2899 attached to the far, upstream end post 1855.

Figure 30:
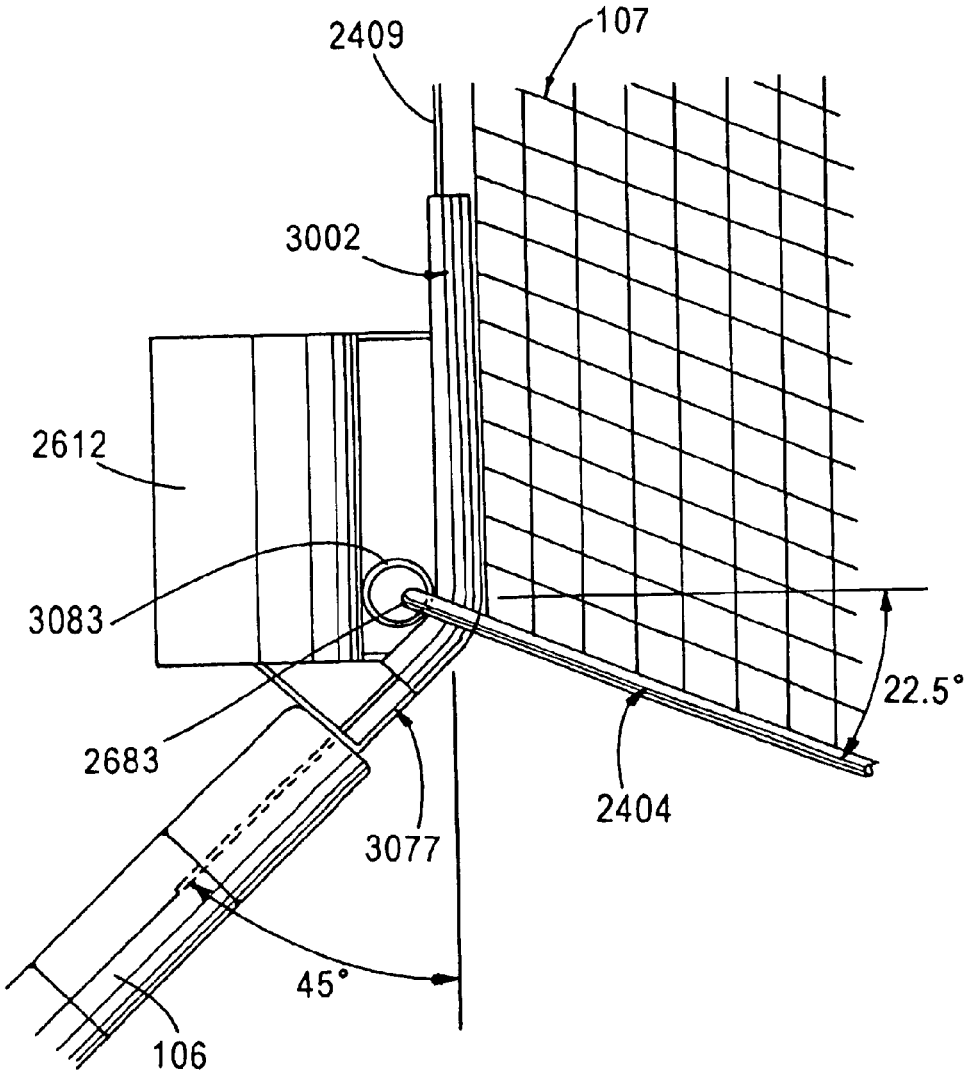
FIG. 30 is an enlarged top plan view of FIG. 29.
Figure 31:
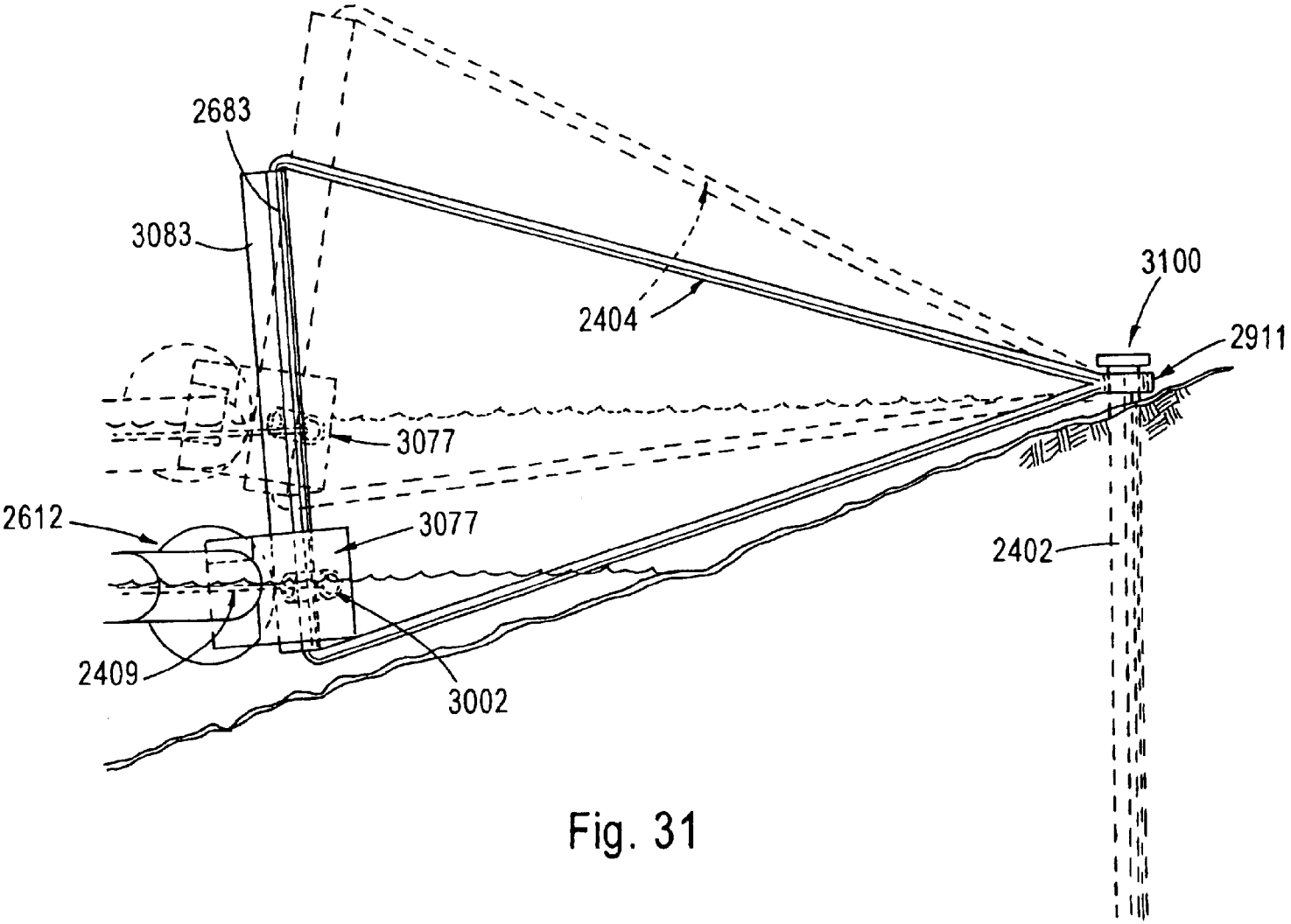
FIG. 31 is a schematic side view showing the floating river debris skimmer of FIG. 28 at different water levels.

Another difference between the embodiments of FIGS. 24 and 28 resides in the triangular frame 2404 and the manner the frame is pivotally attached to the post 2402. In particular, side 2683 of the frame 2404 in the embodiment of FIG. 28 is housed in sleeve 3083 (FIG. 30). The apex 2911 of triangle 2404 is formed as an eye sized to be smaller than the enlarged head portion 3100 of post 2402 but larger than a diameter of the body of the post (FIG. 31). Pulley-like pipe 3002 is provided to protect cable 2409 and positioned between sleeve 3083 and glide plate 3077. Float 2612 is fixed to sleeve 3083 and forces the triangular frame 2404 to pivot up and down, according to the water level, within the limits or clearance defined by eye 2911 and head portion 3100 of post 2402, as best seen in FIG. 31, the phantom line.

Significant improvements are achieved in this embodiment. Instead of requiring a large pile driving machine to drive a pylon into the streambed, as in the embodiment of FIG. 16, this embodiment requires that only two smaller anchor posts 2402 and 1855 be driven in the ground on both sides of the stream at the high water mark of the embankments and, preferably, flush with the ground surface. Since these posts 2402 and 1855 are out of the stream and barely visible, this eliminates what would be a controversial infringement on the natural conditions of the stream. The saving that is gained is herein recommitted to the development of a more sophisticated pole vaulting apparatus with elbow joints. The improved vaulting mechanism will allow the skimming device to be setup in shallower water and will insure greater strength and functional dependability.

While there have been described and illustrated specific embodiments of the invention, it will be clear that variations in the details of the embodiments specifically illustrated and described may be made without departing from the true spirit and scope of the invention as defined in the appended claims.

What is claimed is:

1. A skimmer for selective removal of objects floating on a surface of a stream, said skimmer comprising a float skimming line installed across the stream at an angle with respect to a flowing direction of the stream, said float skimming line having an upstream end and a downstream end and further comprising at least one elongated member extending in the flowing direction of the stream and downwardly from the surface of the stream to a bottom thereof, said elongated member having:

an upper end being attached to said float skimming line at a location between the upstream and downstream ends of said float skimming line; and a lower end removably anchored to the bottom of the stream so that the upper end, and hence said float skimming line, can be pole-vaulted off the surface of the stream when an object of predetermined size and weight traveling downstream hits said float skimming line.

2. The skimmer of claim 1, further comprising a collector installed in the vicinity of the downstream end of said float skimming line to collect floating objects stopped by and guided along said float skimming line.

3. The skimmer of claim 2, wherein said collector is moveable in a vertical direction so as to stay with the water level of the stream as the water level rises or falls.

4. The skimmer of claim 1, wherein the lower end of said elongated member is a weighted pointed end.

5. The skimmer of claim 1, wherein said float skimming line comprises at least one buoyant member to which the upper end of said elongated member is rigidly attached.

6. The skimmer of claim 1, wherein said float skimming line comprises at least one buoyant member to which the upper end of said elongated member is pivotably attached.

7. The skimmer of claim 1, wherein said float skimming line comprises a single buoyant member extending continuously from the upstream end to the downstream end, wherein said single buoyant member is made of a material that is buoyant, flexible and stretchable.

8. The skimmer of claim 1, wherein said float skimming line comprises multiple individual buoyant members connected in series.

9. The skimmer of claim 8, wherein each of said buoyant member has a through bore, and said float skimming line further comprises a string extending through the through bores of said buoyant members to effect said connection of said buoyant members.

10. The skimmer of claim 1, wherein said float skimming line has at least one weak point which will break when an excessive load is applied to said float skimming line.

11. The skimmer of claim 1, further comprising two guiding members each defining a guiding path extending from a bottom of the river upwardly and in the flowing direction of the river, each of the upstream and downstream ends of said float skimming line being attached to be slidable along one of said guiding member.

12. The skimmer of claim 11, wherein each of the upstream and downstream ends of said float skimming line is equipped with a connection ring through which the respective guiding member extends.

13. The skimmer of claim 1, wherein the lower end of said elongated member comprises a flange member for preventing the lower end from sinking into the bottom of the river, and a pointed anchoring projection protruding from the flange member.

14. The skimmer of claim 1, further comprising a submerged log attached to at least one end of the float skimming line for tensioning said float skimming line using the stream current.

15. The skimmer of claim 1, wherein said float skimming line includes at an upstream end thereof an elongated rigid float, said elongated float having a first longitudinal end at or in the vicinity of a high water mark of the stream bank associated with said upstream end of the float skimming line; and a second longitudinal end at or in the vicinity of a low water mark of said stream bank when the water level of the stream is at said low water mark.

16. The skimmer of claim 1, wherein said elongated member has an arm portion including said upper end and a pole portion including said lower end, said arm portion being pivotally attached to said pole portion.

17. A skimmer for selective removal of objects floating on a surface of a stream, said skimmer comprising a float skimming line installed across the stream at an angle with respect to a flowing direction of the stream, said float skimming line having an upstream end and a downstream end and further comprising two guiding members each defining a guiding path extending from a bottom of the stream upwardly and in the flowing direction of the stream, each of the upstream and downstream ends of said float skimming line is attached to be slidable along one of said guiding member so that said float skimming line is free to rise and fall with a surface level of the stream and to be elevated, at least partially, from the surface of the stream when an object of predetermined size and weight traveling downstream hits said float skimming line.

18. A method of selectively skimming debris off a surface of a stream, said method comprising the steps of:

installing a float skimming line across the stream at an angle with respect to a flowing direction of the stream; and collecting said debris at a downstream end of said float skimming line;

said method further comprising the steps of:

attaching a plurality of poles intermittently along the float skimming line so that said poles extending in the flowing direction of the stream and downwardly from the surface of the stream to a bottom thereof, each of said poles having a lower end removably anchored to the bottom of the stream; and allowing the float skimming line to be lifted, at least partially, off the stream surface in a pole-vaulted action using one or more of said poles when a floating object of predetermined size and weight traveling downstream hits said float skimming line, thereby allowing the floating object to pass through without causing damage to said float skimming line.

19. The method of claim 18, further comprising the step of guiding the float skimming line up and down with a water level of the stream along a guiding path extending from a bottom of the stream upwardly and in the flowing direction of the stream.

20. The method of claim 18, further comprising the step of allowing dislodgement of the lower end of at least one of said pole which is attached to the float skimming line in a vicinity of a location where said floating object hits the float skimming line.

21. The method of claim 20, further comprising the step of reseating the lower end of said dislodged pole to an initial position thereof after the dislodgement.

22. The method of claim 18, further comprising the step of reliably breaking said float skimming line at a weak point thereof when said floating object hits the float skimming line with an excessive force.

23. The method of claim 18, wherein the step of collecting said debris comprises:

capturing the debris in a disposable net made of a recyclable material and installed at a downstream end of the float skimming line;

uninstalling and disposing of the disposable net with the debris trapped inside the net; and installing a replacement disposable net at the downstream end of the float skimming line.

24. The method of claim 18, further comprising the step of tensioning the float skimming line to be a substantially straight line, using the stream current.

25. The method of claim 18, wherein the step of collecting said debris comprises capturing the debris in a collecting net installed at a downstream end of the float skimming line;

said method further comprising the step of allowing the net to swivel up and down in accordance with rise or fall of the water level of the stream.

26. The method of claim 18, further comprising the step of allowing the float skimming line to pivot about an elbow joint of at least one of said poles prior to said pole-vaulted action.

* * * * *